US011219118B2

(12) United States Patent
Dobrynin et al.

(10) Patent No.: US 11,219,118 B2
(45) Date of Patent: Jan. 4, 2022

(54) METHOD OF GENERATION OF PLANAR PLASMA JETS

(71) Applicants: Danil V. Dobrynin, Philadelphia, PA (US); Alexander Fridman, Philadelphia, PA (US); Abraham Lin, Ann Arbor, MI (US); Vandana Miller, Philadelphia, PA (US); Adam Snook, Aston, PA (US)

(72) Inventors: Danil V. Dobrynin, Philadelphia, PA (US); Alexander Fridman, Philadelphia, PA (US); Abraham Lin, Ann Arbor, MI (US); Vandana Miller, Philadelphia, PA (US); Adam Snook, Aston, PA (US)

(73) Assignees: Drexel University, Philadelphia, PA (US); Thomas Jefferson University, Philadelphia, PA (US)

( * ) Notice: Subject to any disclaimer, the term of this patent is extended or adjusted under 35 U.S.C. 154(b) by 0 days.

(21) Appl. No.: 16/971,282

(22) PCT Filed: Feb. 20, 2019

(86) PCT No.: PCT/US2019/018689

§ 371 (c)(1),
(2) Date: Aug. 19, 2020

(87) PCT Pub. No.: WO2019/164884

PCT Pub. Date: Aug. 29, 2019

(65) Prior Publication Data

US 2021/0029813 A1 Jan. 28, 2021

Related U.S. Application Data

(60) Provisional application No. 62/632,788, filed on Feb. 20, 2018.

(51) Int. Cl.
*H05H 1/24* (2006.01)

(52) U.S. Cl.
CPC ..... *H05H 1/2406* (2013.01); *H05H 1/2443* (2021.05); *H05H 2240/20* (2013.01); *H05H 2245/30* (2021.05)

(58) Field of Classification Search
CPC ..... H01J 37/32
See application file for complete search history.

(56) References Cited

U.S. PATENT DOCUMENTS 3,501,665 A * 3/1970 Heinz ..... H05H 1/3405 313/146
8,110,155 B2 * 2/2012 Fridman ..... B22F 9/22 422/186.04

(Continued)

OTHER PUBLICATIONS

International Search Report and Written Opinion for corresponding International application No. PCT/US2019/018689; dated Jun. 10, 2019 (9 pages).

(Continued)

*Primary Examiner* — Amy Cohen Johnson
*Assistant Examiner* — Srinivas Sathiraju
(74) *Attorney, Agent, or Firm* — Mendelsohn Dunleavy, P.C.

(57) ABSTRACT

Applications of dielectric barrier discharge (DBD) based atmospheric pressure plasma jets are often limited by the relatively small area of treatment due to their 1D configuration. This system generates 2D plasma jets permitting fast treatment of larger targets. DBD evolution starts with formation of transient anode glow, and continues with development of cathode-directed streamers. The anode glow can propagate as an ionization wave along the dielectric surface through and outside of the discharge gap. Plasma propagation is not limited to 1D geometry such as tubes, and can be organized in a form of a rectangular plasma jet, or other 2D (Continued)

or 3D shapes. Also described are a method for generating 2D plasma jets and use of the 2D plasma jets for cancer therapy.

20 Claims, 21 Drawing Sheets

(56) References Cited

U.S. PATENT DOCUMENTS

| | | | | |
|---|---|---|---|---|
| 8,388,618 | B2 * | 3/2013 | Fridman | A61B 18/042 606/49 |
| 8,460,283 | B1 * | 6/2013 | Laroussi | H05H 1/42 606/34 |
| 8,521,274 | B2 * | 8/2013 | Gutsol | A61B 18/042 607/2 |
| 8,641,152 | B2 * | 2/2014 | Pursifull | B60T 7/042 303/114.1 |
| 8,784,657 | B2 * | 7/2014 | Cho | B01D 35/06 210/269 |
| 8,864,953 | B2 * | 10/2014 | Gutsol | C10J 3/18 204/169 |
| 8,992,518 | B2 * | 3/2015 | Fridman | H05H 1/24 606/41 |
| 9,216,400 | B2 * | 12/2015 | Rabinovich | H05H 1/44 |
| 9,339,783 | B2 * | 5/2016 | Fridman | B01J 19/087 |
| 9,352,984 | B2 * | 5/2016 | Campbell | C02F 1/48 |
| 9,511,240 | B2 * | 12/2016 | Dobrynin | A61N 1/0468 |
| 9,540,257 | B2 * | 1/2017 | Cho | C02F 1/4608 |
| 9,675,716 | B2 * | 6/2017 | Hancock | A61L 2/02 |
| 10,098,687 | B2 * | 10/2018 | Staack | G01N 27/68 |
| 10,500,407 | B2 * | 12/2019 | Dobrynin | A61N 1/0472 |
| 10,688,204 | B2 * | 6/2020 | Hancock | A61L 2/02 |
| 2008/0251012 | A1 * | 10/2008 | Tabata | B01J 37/0238 118/638 |
| 2009/0200267 | A1 * | 8/2009 | Shim | C23C 4/134 216/67 |
| 2010/0193129 | A1 * | 8/2010 | Tabata | H01J 37/32009 156/345.35 |
| 2016/0236002 | A1 | 8/2016 | Dirk et al. | |
| 2017/0296836 | A1 | 10/2017 | Dobrynin et al. | |
| 2021/0029813 | A1 * | 1/2021 | Dobrynin | H05H 1/2406 |

OTHER PUBLICATIONS

International Preliminary Report on Patentability for corresponding International application No. PCT/US2019/018689; dated Aug. 27, 2020 (6 pages).

Dobrynin, Danil, et al. "Planar Helium Plasma Jet: Plasma "Bullets" Formation, 2D "Bullets" Concept and Imaging." Plasma Medicine 8.2 (2018): 177-184.

Fanelli, Fiorenza, et al. "Atmospheric pressure non-equilibrium plasma jet technology: general features, specificities and applications in surface processing of materials" Surface & Coatings Technology 322 (2017): 174-201.

Ghasemi, M., et al. "Interaction of multiple plasma plumes in an atmospheric pressure plasma jet array." Journal of Physics D: Applied Physics 46.5 (2013): p. 052001 (6 pages).

Li, Jing, et al. "A Highly Cost-Efficient Large-Scale Uniform Laminar Plasma Jet Array Enhanced by V—I Characteristic Modulation in a Non-Self-Sustained Atmospheric Discharge." Advanced Science 7.6 (2020): p. 1902616 (12 pages).

Lin, Abraham G., et al. "Non-thermal plasma induces immunogenic cell death in vivo in murine CT26 colorectal tumors." Oncolmmunology 7.9 (2018): pp. e1484978 (13 pages).

Nie, Q.Y., et al. "A two-dimensional cold atmospheric plasma jet array for uniform treatment of large-area surfaces for plasma medicine." New Journal of Physics 11.11 (2009): p. 115015 (14 pages).

Winter, J., et al. "Atmospheric pressure plasma jets: an overview of devices and new directions." Plasma Sources Science and Technology 24.6 (2015): p. 064001 (19 pages).

* cited by examiner

| | [redacted] | [redacted] |
|---|---|---|
| Media | 40% | 0% |
| Cisplatin | 40% | 10% |
| Plasma | 90% | 30% |

METHOD OF GENERATION OF PLANAR PLASMA JETS

CROSS REFERENCE TO RELATED APPLICATIONS

This application claims the benefit of U.S. Provisional Application No. 62/632,788, filed on Feb. 20, 2018, the entire disclosure of which is hereby incorporated by reference as if set forth fully herein.

STATEMENT OF GOVERNMENT INTEREST

This invention was made with government support under Contract No. DE-SC0016492 awarded by the Department of Energy. The Government has certain rights in the invention.

FIELD OF THE INVENTION

The present invention relates to a plasma generator for forming a plasma jet with improved treatment of large surface area targets.

BACKGROUND OF THE INVENTION

Non-thermal atmospheric plasma jets (APPJ) based on dielectric barrier discharge (DBD) have attracted considerable interest in the recent decades [1-3]. Multiple research groups have studied these plasma sources for various applications like surface modification [5, 6], decontamination [6-9], cancer treatment [10-12], including plasma-induced immunotherapy and direct tumor ablation, and others, as well as their thorough diagnostics to understand chemical and physical characteristics. One of the important challenges and limitations of existing one dimensional (1D) plasma jets is their relatively low area of treatment [13-19] which results from the small size of the plasma jet. This invention is designed to address this problem and offer possibility to generate two dimensional (2D) plasma jets that allow fast treatment of large surface area targets.

Many reports have shown that plasma jets propagate via so-called "plasma bullets", or a train of discrete surface ionization waves traveling along a dielectric surface (sometimes to address the ionization wave reconnection to the "parent" dielectric barrier discharge (DBD) plasma, they are called "pulsed atmospheric-pressure plasma streams (PAPS)"). Although the physics of the propagation of 1D jets and plasma "bullets" has been described [20-30], the connection between the processes in the DBD plasma and "bullet" initiation is still not clearly understood.

Recent studies, including both in vitro and in vivo experiments, have shown that cold atmospheric plasma is a promising tool for cancer therapy [35-37]. In [36], it was shown that by optimizing the parameters of plasma to induce local immunogenic cell death in tumors, it is possible to systemically trigger specific, protective immune responses. The observed cellular responses are mainly due to various plasma-originated reactive species, including hydrogen peroxide, singlet oxygen, superoxide, NO2-, ONOO—, NO and others [35]. Plasma "bullets" originate from the initial anode glow (surface discharge) in DBD that precedes volumetric streamer discharge and propagates along the surface of dielectric to later form the jet upon exiting outside of the discharge chamber into the atmosphere. Based on this concept, the inventors have altered the classic 1D tube configuration used to generate APPJ's to provide a 2D plasma jet.

Immunogenic cell death is characterized by the emission of danger signals that facilitate activation of an adaptive immune response against dead-cell antigens. In the case of cancer therapy, tumor cells undergoing immunogenic death promote cancer-specific immunity. Identification, characterization, and optimization of stimuli that induce immunogenic cancer cell death has tremendous potential to improve the outcomes of cancer therapy.

Cancer treatment strategies in the past have focused on reducing tumor burden through delivery of cytotoxic agents. These methods often do not rely on the patient's adaptive immune responses for the resolution of cancer. Thus, once cells escape treatment, they continue to grow, resulting in tumor recurrence and resistance to therapy. [38-40] Immunogenic cell death (ICD), initially described by Zitvogel, Kroemer, and co-workers, is a modality of death where dying cells stimulate immune responses against dead-cell antigens. [41-43] In cancer therapy, this is advantageous as tumor cells undergoing ICD activate an anti-tumor immune response that is specific for that cancer. Therefore, developing treatments that elicit immunogenic cell death and facilitate the active participation of the patient's adaptive immune system, offer the potential to improve clinical outcomes of cancer therapy.

Plasma, the fourth state of matter, is ionized gas composed of charged particles, active neutral gas species, electric fields, and low amounts of ultraviolet (UV) light. [44-48] Development of plasma systems that can be sustained in atmospheric pressure and at room temperature has opened doors for biomedical applications, including, but not limited to, cancer therapy. [49-51] Mounting evidence demonstrates that these 'non-thermal plasmas' (NTP) can be optimized to destroy tumors with minimal damage to neighboring healthy tissue. [51-54] Decreased tumor burden and prolonged animal survival following direct plasma treatment have been reported, suggesting that plasma should be further explored as a viable candidate for cancer treatment. [55]

The potential of NTP to induce immunogenic cancer cell death is only recently being explored. Bekeschus, et al. has demonstrated that NTP treatment of two murine cell lines in vitro, the B16F10 melanoma cells and the CT26 colorectal cancer cells, increased immunogenic cell surface molecules such as major histocompatibility complex I (MHC-I) and surface exposed calreticulin (ecto-CRT). [56-57] We have reported successful in vitro ICD induction in two human cell lines, a radiation resistant primary nasopharyngeal carcinoma cell line (CNE-1) and the A549 lung carcinoma cell line in response to NTP exposure. [58-59]

The mechanism is postulated to be reactive oxygen and nitrogen species (RONS) dependent. NTP-generated RONS rapidly change the oxidative status of cells and induce endoplasmic reticulum (ER) stress pathways in these cells. [56-59] Upregulation of two proteins associated with ER stress and upstream of CRT emission, activating transcription factor 4 (ATF4) and stanniocalcin (STC2), was also demonstrated. [58] Moreover, abrogation of NTP-generated and cell-stimulated RONS tempered the effect of NTP on CRT emission. These reports indicate that NTP-induced ICD is not specific to a single cancer cell type, and merits further investigation into its clinical relevance as an anti-cancer modality. Plasma treatment in animal models of cancers is needed to assess if plasma-induced ICD could benefit patient outcome.

SUMMARY

In a first aspect, present invention relates to a plasma generator for forming a plasma jet includes a dielectric body comprising four sides and two ends defining a cavity located within the dielectric body, the cavity having a length extending from a first end of the body to a second end of the body, a height extending from a first side of the body to a second side of the body, the second side located opposite the first, and a width measured orthogonal to the length and height, and the width of the cavity is greater than the height of the cavity. The dielectric body includes at least one aperture in the second end of the dielectric body, a high voltage electrode located proximate to the first side of the dielectric body and having a surface facing toward the cavity, a grounded electrode located proximate to said second side of the dielectric bo dy and having a surface facing toward the surface of the high voltage electrode, and a distance between the surface of the grounded electrode and the surface of the high voltage having a variability of no greater than 10%, at least one gas inlet formed proximate to the first end of the dielectric body, and a power supply connected to said high voltage electrode, wherein the power supply is configured to provide an alternating energy to said high voltage electrode.

In the foregoing embodiment, the plasma generator may have a distance between the high voltage electrode and the grounded electrode measured through air outside of the dielectric body of greater than a distance that would permit an electrical connection between the high voltage electrode and the grounded electrode when the plasma generator is in operation.

In each of the foregoing embodiments, the plasma generator may have a volume and velocity of a gas entering the at least one gas inlet sufficient to prevent air from entering the cavity through the aperture.

In each of the foregoing embodiments, the plasma generator may have a width of the aperture of less than a width of the high voltage electrode as measured in the same direction as the width of the aperture. Alternatively, in each of the foregoing embodiments, the plasma generator may have a width of the aperture of greater than a width of the high voltage electrode as measured in the same direction as the width of the aperture. Also, in each of the foregoing embodiments, the plasma generator may have a width of the aperture within 10% of a width of the high voltage electrode as measured in the same direction as the width of the aperture. In the foregoing embodiments, the plasma generator may have a width of the aperture of at least 1 cm, or from 1 cm to 1.5 m, or from 1 cm to 3 cm.

In each of the foregoing embodiments, the plasma generator may have a ratio of a width of the aperture to a height of the aperture of at least 3:1.

In each of the foregoing embodiments, the plasma generator may have an aperture with a rectangular shape.

In each of the foregoing embodiments, the plasma generator may have gas introduced into the cavity through the at least one gas inlet which gas may have at least 90% by volume of a noble gas or at least 90% by volume of a mixture of noble gases, or at least 95% by volume of a noble gas or at least 95% by volume of a mixture of noble gases.

In a second aspect, the present invention relates to a method of generating a plasma jet utilizing the plasma generator as set forth in each of the foregoing embodiments, including steps of: feeding a carrier gas into the cavity to cause the carrier gas to flow from the at least one gas inlet through the aperture; and applying a pulsed voltage at a regulated frequency to the high voltage electrode while feeding the carrier gas.

The planar plasma jet generated by the present invention may be used for cancer therapy, including plasma-induced immunotherapy. For therapeutic use, the plasma jet may be operated within one or more of the following ranges of parameters: a treatment time of from 5 to 300 s, an excitation voltage of from 5 to 40 kV, a pulse repetition frequency of from 50 to 3000 Hz, and a pulse width of from 20 ns to 20 μs.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 6A is a cut-away side view of the plasma generator and FIG. 6B is a cut-away top view of the plasma generator of FIG. 6A.

FIG. 7A shows cell viability, indicated by the percentage of live CT26 cells normalized to untreated (0 mJ), 24 hours after plasma treatment.

FIG. 7B shows representative histograms of the CRT data shown in FIG. 7C.

FIG. 7C shows mean fluorescence intensity (MFI) shown to increase surface CRT following plasma treatment and CRT detected on the surface of intact CT26 cells 24 hours after plasma exposure.

FIG. 7D shows ATP content detected in the media 10 minutes after plasma treatment using a chemiluminescent kit. CRT, ATP, and viability data are presented as means±S.E.M. *$p<0.05$, $p<0.01$, *$p<0.001$ (one-way ANOVA, Dunnett's multiple comparison test).

FIG. 8A shows Balb/c mice were injected with media-, Cisplatin-, or plasma-treated CR26 cells subcutaneously into the left flank (n=10 per group). One week later, the mice were challenged with live CT26 cell on the opposite flank and monitored for 26 days. Challenge tumors grew more rapidly in mice immunized with cells treated with media (B) or Cisplatin (C) compared to mice immunized with plasma-treated cells (D).

FIGS. 8B, 8C and 8D show data indicating tumor growth of each mouse. A dotted line is plotted to indicate the mean tumor volume of the control group (media treatment).

FIG. 8E shows that mean tumor volumes in the mice vaccinated with plasma-treated cells were significantly smaller compared to those immunized with untreated cells. Data are presented in FIG. 8E as mean value±S.E.M. ***p<0.001 (Two-way ANOVA, Dunnett's multiple comparisons test).

FIG. 8F shows the percentage of mice with tumor volumes less than the mean volume of the media group and the percentage of mice that did not develop subcutaneous tumors at the challenge site.

FIG. 9A shows a nanosecond-pulsed power supply that generated 29 kV pulses and a function generator used to control the frequency of pulses and the plasma exposure time. A z-positioner was used to hold the high voltage electrode in place during treatment, approximately 1 to 2 mm above the target.

FIG. 9B shows that the plasma was generated directly above the subcutaneous tumor.

FIGS. 10A-10D and 10E-10H, show tumors with overlaying skin resected for 1 day, and 3 days, respectively, following the final plasma treatment.

FIGS. 10A and 10E show tumors that received no treatment.

FIGS. 10B and 10F show tumors with 25-second treatment.

FIGS. 10C and 10G show tumors with 50-second treatment.

FIGS. 10D and 10H show tumors treated daily over the course of 5 days. Images were taken at 20×. The inset in FIG. 10H shows neutrophil infiltration.

FIGS. 11A and 11B show the emission of CRT and HMGB1, respectively, increased in all plasma treatment groups by ~1.5-fold.

FIGS. 11C and 11D show the presence of leukocytes (FIG. 11C, CD45+ cells) and APCs (FIG. 11D, CD11c+ cells) increased compared to untreated tumors. The data is presented from individual resected tumors. *p<0.05, **p<0.05 (One-way ANOVA, Dunnett's multiple comparisons test).

FIG. 11E shows representative images of tumors subject to multi-spot plasma treatment compared to untreated controls (10×, 400 μm×400 μm).

FIG. 12A shows mice challenged with CT26-GUCY2C cells (day 0) and treated with plasma on day 7. A subgroup of the plasma-treated mice was vaccinated on day 14 with Ad5-GUCY2C-S1.

FIGS. 12B and 12C show GUCY2C-specific and AH!-specific T-cell responses, respectively, quantified by IFNγ ELISpot in the spleen o.

Figure 1A:
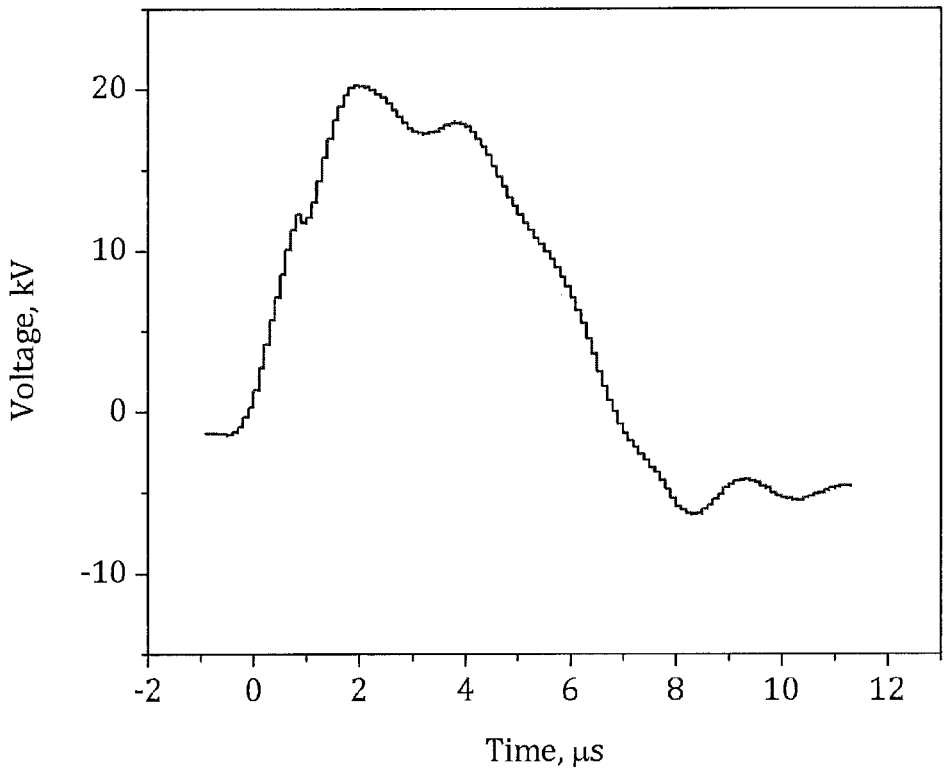
FIG. 1A shows a typical voltage waveform.

Additional details and advantages of the disclosure will be set forth in the description which follows, and/or may be learned by practice of the disclosure. The details and advantages of the disclosure may be realized and attained by means of the elements and combinations particularly pointed out in the appended claims.

DETAILED DESCRIPTION OF THE PREFERRED EMBODIMENTS

For illustrative purposes the principles of the present invention are described by referencing various exemplary embodiments thereof. Although certain embodiments of the invention are specifically described herein, one of ordinary skill in the art will readily recognize that the same principles are equally applicable to, and can be employed in other apparatuses and methods. Before explaining the disclosed embodiments of the present invention in detail, it is to be understood that the invention is not limited in its application to the details of any particular embodiment shown. The terminology used herein is for the purpose of description and not of limitation. Further, although certain methods are described with reference to certain steps that are presented herein in certain order, in many instances, these steps may be performed in any order as may be appreciated by once skilled in the art, and the methods are not limited to the particular arrangement of steps disclosed herein.

As used herein and in the appended claims, the singular forms "a", "an", and "the" include plural references unless the context clearly dictates otherwise. The terms "a" (or "an"), "one or more" and "at least one" can be used interchangeably herein. It is also to be noted that the terms "comprising", "including", and "having" can be used interchangeably.

Disclosed herein is a plasma generator for forming a plasma jet and methods of generating and using the plasma jet.

The present invention relates to a plasma generator for forming a plasma jet which may include two electrodes, a high voltage electrode and a grounded electrode. The high voltage electrode and the grounded electrode are located on opposite side of a dielectric body, and the surfaces of each electrode face towards each other, as well as facing the inside of the cavity in the dielectric body. The electrodes may have any shape, but the surfaces should be substantially equidistant from each other.

Preferably, substantially equidistant means that the distance between the surfaces varies by less than 10% over the surfaces. More preferably, the distance between surfaces does not vary more than 5%, and most preferably the distance varies less than 3%.

The high voltage electrode is preferably located proximate to the first side of the dielectric body and the grounded electrode is preferably located proximate to the second side of the dielectric body. The surfaces of the high voltage and grounded electrode face the cavity. A power supply is connected to the high voltage electrode, and the power supply is configured to provide an alternating energy to the high voltage electrode. Preferably, the energy is a pulsed energy.

When pulsed energy is applied to the high voltage electrode an electric field is produced and an ionization wave is formed along the surface of the cavity adjacent to the high voltage electrode. The plasma jet formed by this action then propagates along that surface towards the second end of the cavity, and exits the dielectric body through the aperture. Upon exit, the plasma jet takes the shape of the aperture. As such, the shape of the plasma jet can be controlled through the use of differently shaped apertures. Additionally, differently shaped electrodes and cavities may be used alone or in conjunction with the shape of the aperture to further influence the shape of the plasma jet. Any shape for the electrodes and cavity may be used, so long as the sides of the cavity do not block the forward propagation of the plasma jet. Most preferably, the dielectric body is cuboid, the electrodes are substantially flat with rectangular surfaces, and the aperture is also rectangular.

The preferred rectangular aperture, preferably has a width and height measured in the same direction as the width and height of the dielectric body. In a preferred embodiment, the aperture has a width to height ratio of at least 3:1. Also, preferably, the width of the aperture is at least 1 cm, and more preferably, the width ranges from 1 cm to 3 cm. Although preferable dimensions are provided above for the width of the aperture, it is known that any width is possible, so long as enough power is supplied to the electrodes to form a sufficient plasma plume.

The at least one gas inlet is located proximate to the first end of the dielectric body, which is the end opposite from the aperture. One or more gas inlets can be located within the first end, or may be located on one or more of the sides at a location close to the first end. The number, location, and size of the gas inlets, as well as the rate of gas flow is adjusted to prevent air from entering the aperture. These gas flow parameters may also be adjusted to control the plasma jet discharge through the aperture and the mixing with air at the aperture exit.

Preferably, the gas entering the cavity through the at least one gas inlet is contains at least 90% by volume of a noble gas, or at least 90% by volume of a mixture of two or more noble gases, or at least 95% by volume of a noble gas, or at least 95% by volume of a mixture of two or more noble gases.

The length of the dielectric body is variable, but must be sufficiently long for the ionization wave to be formed and propagate. The width of the dielectric body is dependent on the desired shape and aperture size. An aperture with a larger width requires a dielectric body with a larger width, and in most cases wider electrodes. However, the width of the electrodes does not have to be equal to the width of the aperture, and may be either larger or smaller than the aperture width. Preferably, the width of the electrodes is substantially similar to the width of the aperture, or the widths of the electrodes and aperture are within about 10% of each other.

The height of the dielectric body has a minimum and a maximum. The height should be sufficient to help ensure that there is sufficient distance to prevent electrical contact of the high voltage electrode and the ground electrode through the air around the dielectric body. The maximum the height can be is the distance at which an electric field will no longer be created. These distances are dependent on the power being supplied to the electrodes, as well as their size and shape, along with the other dimensions and shape of the dielectric body and can be determined by a skilled person.

Based on the controllable size and shape of the plasma jet that can be created with the present invention, many different applications are possible, for example, removal of photoresist, oxide films and organic residues from wafers for the electronics industry, decontamination of civilian and military areas and personnel exposed to chemical or biological warfare agents, and paint removal. In addition to these listed applications, the present device and method of creating a plasma jet would be suitable for use with newly developed applications, as it allows for the adjustment of the size and shape of the plasma jet to allow it to be used with any surface and for any purpose known or learned by those in the art to be a useful application of plasma jets.

Figure 6A:
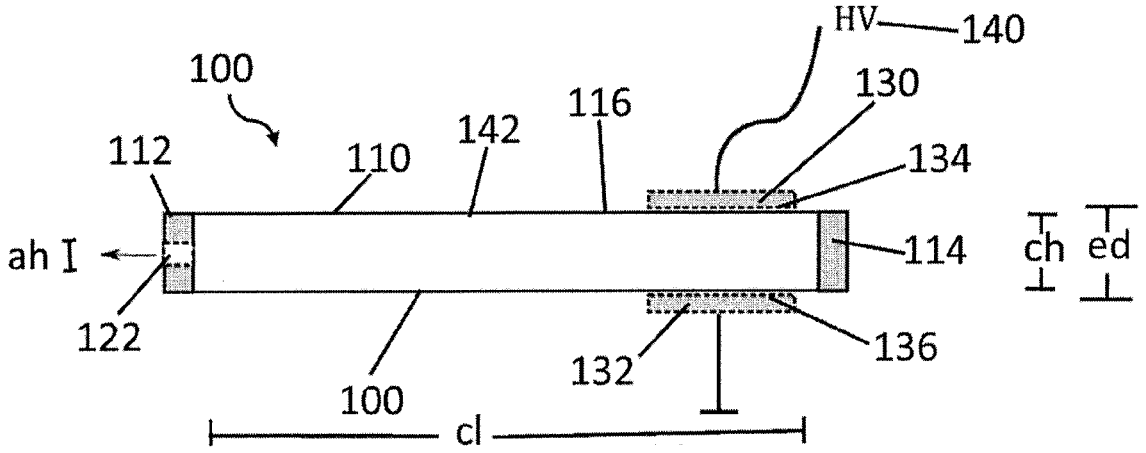
FIGS. 6A-B show one embodiment of the present plasma generator.
Figure 6B:
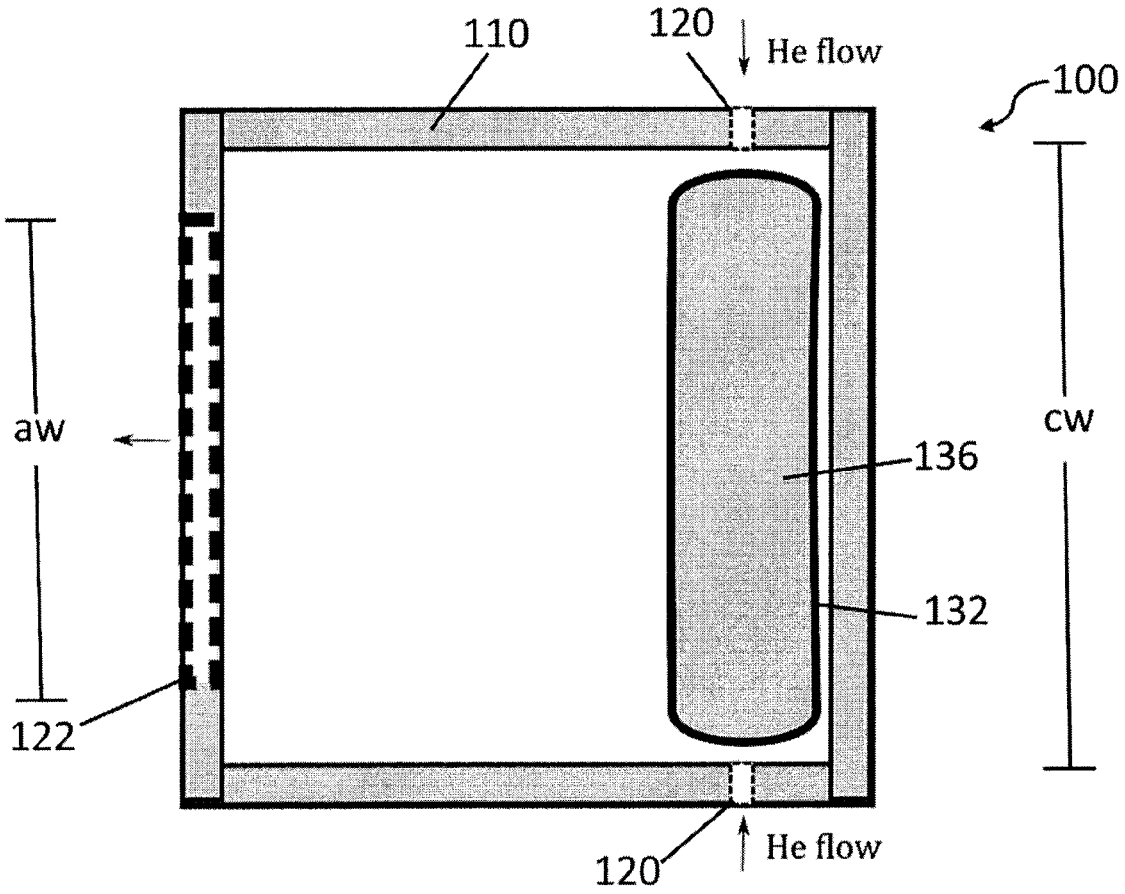

One embodiment of the present plasma generator is shown in FIGS. 6A-6B. FIG. 6A is a cut-away side view of a plasma generator and FIG. 6B is a cut-away top view of the plasma generator of FIG. 6A. The plasma generator 100 of the present invention comprises a dielectric body 110. The dielectric body 110 can have any shape, but preferably has four sides and two ends (112. 114). A cavity is located within the dielectric body. The cavity has a length (cl) extending from a first end 112 of the body to a second end 114 of the body, a height (ch) extending from a first side 116 of the body to a second side 118 of the body, the second side 118 is located opposite the first side 116. The cavity also has a width (cw) measured orthogonal to the length (cl) and height (ch). The width (cw) of the cavity is greater than the height (ch) of the cavity. Preferably, proximate to the first end 112 is at least one gas inlet 120, and proximate to the second end 114 there is at least one aperture 122.

A plasma generator 100 for forming a plasma jet according to the present invention comprises two electrodes, a high voltage electrode 130 and a grounded electrode 132. The high voltage electrode 130 and the grounded electrode 132 are located on opposite sides of a dielectric body 110, and the surfaces 134 and 136 of each electrode are facing towards each other, as well as the inside of the cavity in the dielectric body 110. The electrodes may have any shape, but the surfaces should be substantially equidistant from each other. Preferably, substantially equidistant means that the distance (ed) between the surfaces varies by less than 10% over the surfaces. More preferably, the distance between surfaces does not vary more than 5%, and most preferably the distance varies less than 3%.

The high voltage electrode 130 is preferably located proximate to the first side 116 of the dielectric body 110 and the grounded electrode 132 is preferably located proximate to the second side 118 of the dielectric body 110. The surfaces 134 and 136 of the high voltage and grounded electrode face the cavity. A power supply 140 is connected to the high voltage electrode 130, and the power supply 140 is configured to provide an alternating energy to the high voltage electrode 130. Preferably, the energy supplied is a pulsed energy.

When pulsed energy is applied to the high voltage electrode an electric field is produced and an ionization wave (plasma jet) is formed along the surface of the cavity adjacent to the high voltage electrode 142. The plasma jet formed by this action then propagates along the surface towards the first end 112 of the cavity, and exits the dielectric body 110 through the aperture 122. Upon exiting, the plasma jet takes the shape of the aperture. As such, the shape of the jet can be controlled through the use of differently shaped apertures. Additionally, differently shaped electrodes and cavities may be used alone or in conjunction with the differently shaped apertures to further influence the shape of the plasma jet. Any shape for the electrodes and cavity may be used, so long as the sides of the cavity do not block the forward propagation of the plasma jet. Most preferably, the dielectric body is cuboid, the electrodes are substantially flat with rectangular surfaces, and the aperture is also rectangular.

The preferred rectangular aperture 122, preferably has a width (aw) and height (ah) measured in the same direction as the width (cw) and height (ch) of the cavity defined by the dielectric body 110. In a preferred embodiment, the aperture 122 has a width to height ratio of at least 3:1. Also, preferably, the width of the aperture is at least 1 cm, more preferably, the width ranges from 1 cm to 1.5 m, and most preferably, the width ranged from 1 cm to 3 cm. Although preferable dimensions are provided above for the width of the aperture, it is known that any width is possible, so long as enough power is supplied to the electrodes to form a sufficient plasma plume.

The at least one gas inlet 120 is located proximate to the second end 114 of the dielectric body, which is the end opposite from the aperture 122. One or more gas inlets 120 can be located within the second end 114, or may be located on one or more of the sides at a location close to the second end. The number, location, and size of the gas inlets, as well as the rate of gas flow is adjusted to prevent air from entering the aperture. These gas flow parameters may also be adjusted to control the plasma jet discharge through the aperture and the mixing with air at the aperture exit.

Preferably, the gas entering the cavity through the at least one gas inlet is comprise of at least 90% of a noble gas, or at least 90% of a mixture of two or more noble gases.

The length (cl) of the cavity defined by the dielectric body is variable, but must be sufficiently long for the ionization wave to be formed and propagate. The width (cw) of the cavity defined by the dielectric body is dependent on the desired shape and aperture size. An aperture 122 with a larger width (aw) requires a dielectric body with a larger width (cw), and in most cases wider electrodes 130 and 132. However, the width of the electrodes does not have to be equal to the width of the aperture, and may be either larger or smaller than the aperture width. Preferably, the width of the electrodes is substantially similar to the width of the aperture, or that the widths are within 10% of each other.

The height of the cavity (ch) defined by the dielectric body has a minimum and a maximum. The minimum the height can be is the distance that will prevent electrical contact of the high voltage electrode and the ground electrode through the air around the dielectric body. The maximum the height can be is the distance at which an electric field will no longer be created. These distances are dependent on the power being supplied to the electrodes, as well as their size and shape, along with the other dimensions and shape of the dielectric body.

Based on the controllable size and shape for the plasma jet that can be created with the present invention, many different applications are possible, for example, removal of photoresist, oxide films and organic residues from wafers for the electronics industry, decontamination of civilian and military areas and personnel exposed to chemical or biological warfare agents, and paint removal. In addition to these listed applications, the present device and method of creating a plasma jet is usable with any newly developed application, as it allows for the adjustment of the size and shape of the plasma to allow it to be used with any surface and for any purpose known or learned by those in the art to be a useful application of plasma jets.

The present invention also relates to a method of generating a plasma jet utilizing the plasma generator as set forth above. The method includes steps of: feeding a carrier gas into the cavity to cause the carrier gas to flow from the at least one gas inlet through the aperture; and applying a pulsed voltage at a regulated frequency to the high voltage electrode while feeding the carrier gas.

The planar plasma jet generated by the present invention may be used for cancer therapy, including plasma-induced immunotherapy. For therapeutic use, the plasma jet may be operated within one or more of the following ranges of parameters: a treatment time of from 5 to 300 s, an excitation voltage of from 5 to 40 kV, a pulse repetition frequency of from 50 to 3000 Hz, and a pulse width of from 20 ns to 20 μs.

Plasma Induces Emission of Surrogate Markers of ICD

Non-thermal, atmospheric pressure plasma can be operated to induce immunogenic cell death in an animal model of colorectal cancer. In vitro, plasma treatment of CT26 colorectal cancer cells induced the release of classic danger signals. Treated cells were used to create a whole-cell vaccine which elicited protective immunity in the CT26 tumor mouse model. Moreover, plasma treatment of subcutaneous tumors elicited emission of danger signals and recruitment of antigen presenting cells into tumors. An increase in T cell responses targeting the colorectal cancer-specific antigen guanylyl cyclase C (GUCY2C) were also observed. This is evidence that non-thermal plasma induces immunogenic cell death and highlights its potential for clinical translation for cancer immunotherapy.

Figure 7A:
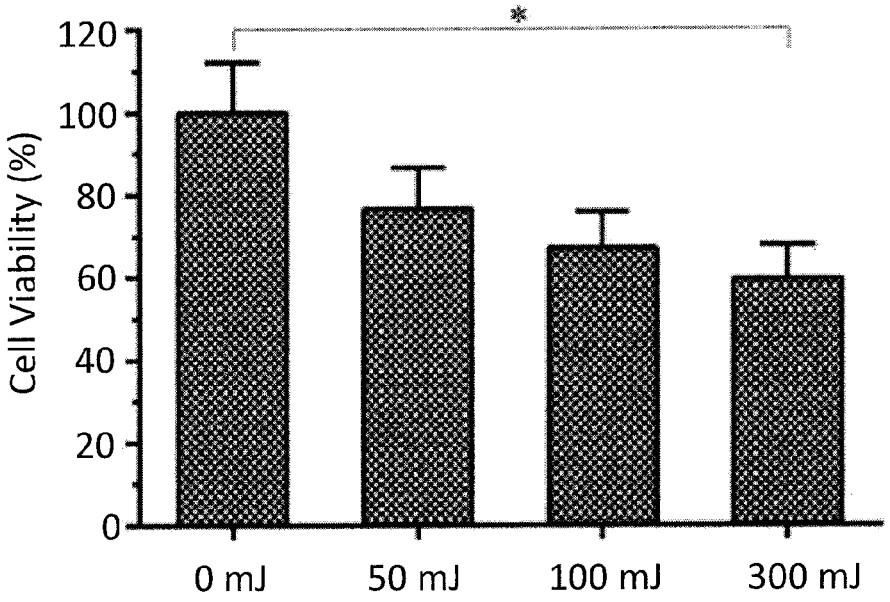
FIGS. 7A-D show plasma-induced cell death, surface emission of CRT, and secretion of ATP in CT26 cells.

In these examples, the CT26 murine colorectal tumor model was used to explore the potential of NTP to induce ICD in vivo. NTP generated by a nanosecond-pulsed dielectric barrier discharge (nspDBD) plasma system induced the expression of two key surrogate markers of ICD in these cancer cells: ecto-calreticuline (ecto-CRT) and secreted adenosine triphosphate (ATP). A vaccination assay, used to determine if a stimulus is an ICD inducer, showed partial protective immunity against tumor challenge in syngeneic Balb/c mice immunized with NTP treated CT26 cells. Furthermore, treatment of subcutaneous colorectal tumors expressing the cancer antigen guanylyl cyclase C (GUCY2C) resulted in higher expression of ICD markers in tumors, recruitment of antigen presenting cells (APCs), and generation of more GUCY2C-specific T cells. This establishes that plasma may be used for cancer immunotherapy via ICD To measure cell death in response to nspDBD plasma, the CT26 colorectal carcinoma cell line was exposed to several plasma energies. Cell viability, quantified with a Muse Cell Analyzer 24 hours after plasma treatment, decreased in an energy dependent manner (FIG. 7A). As previously described, not all modalities of cell death are immunogenic and capable of initiating anti-tumor effects. The identification of ICD in vitro mainly relies on detection of associated damage associated molecular patterns (DAMPs). Therefore, the effect of plasma on cell viability was examined and two DAMP signals in CT26 cells: externalization of CRT and secretion of ATP. [60]

Figure 7B:
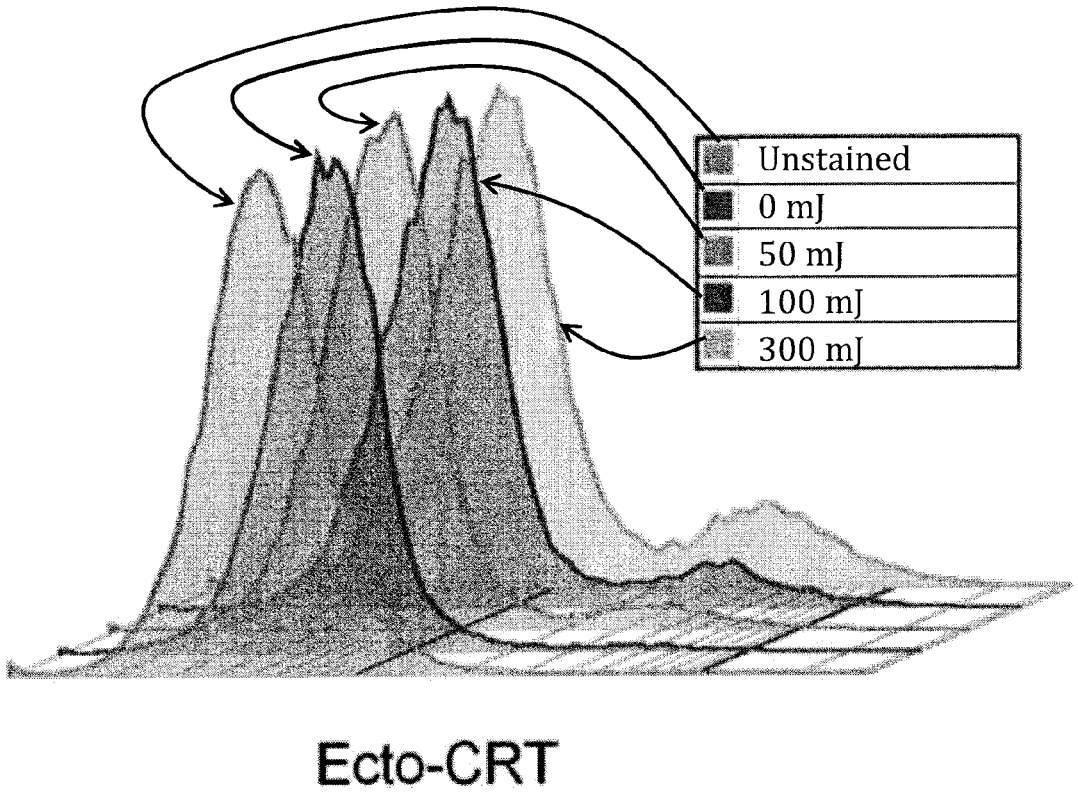
Figure 7C:
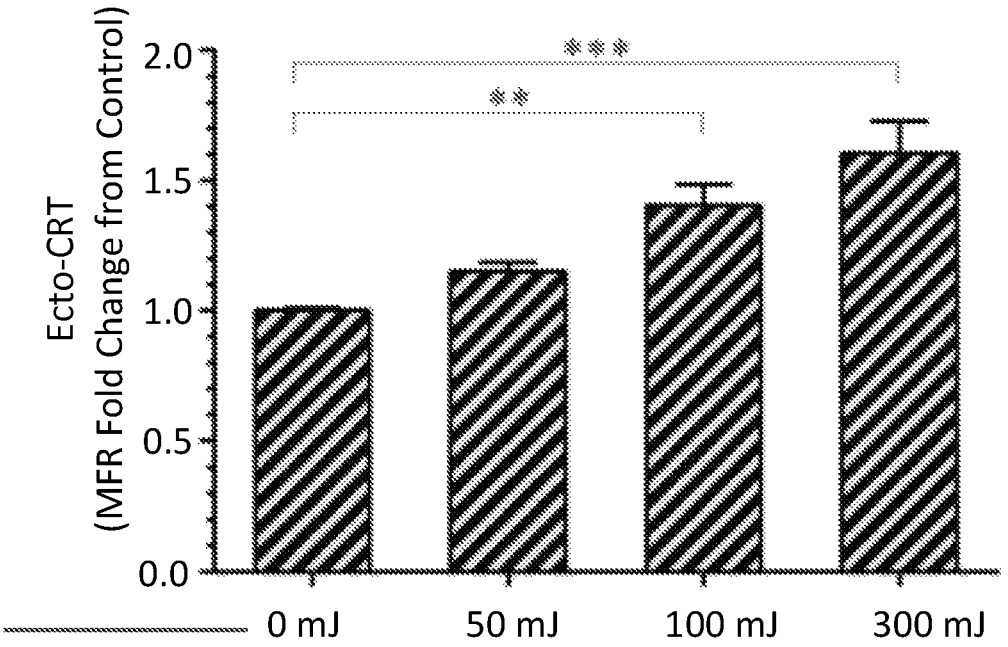

Immunogenicity of dying cancer cells is strongly dictated by surface exposure of CRT. [61] Normally located on the ER membrane, exposed CRT on the cell surface acts as an 'eat me' DAMP signal that facilitates recognition, engulfment, and processing of tumor cells by APCs, [62-64] a critical step for the initiation of an adaptive anti-cancer response. [65-67] Surface-exposure of CRT in response to 10 second plasma exposure was measured 24 hours after treatment. Intact cells were labeled with anti-CRT antibodies, stained with fluorescent secondary antibodies and analyzed using flow cytometry. Our results show that the emission of ecto-CRT on CT26 cells increased in an energy dependent manner, suggesting plasma may increase the immunogenicity of tumor cells (FIGS. 7B-7C).

Figure 7D:
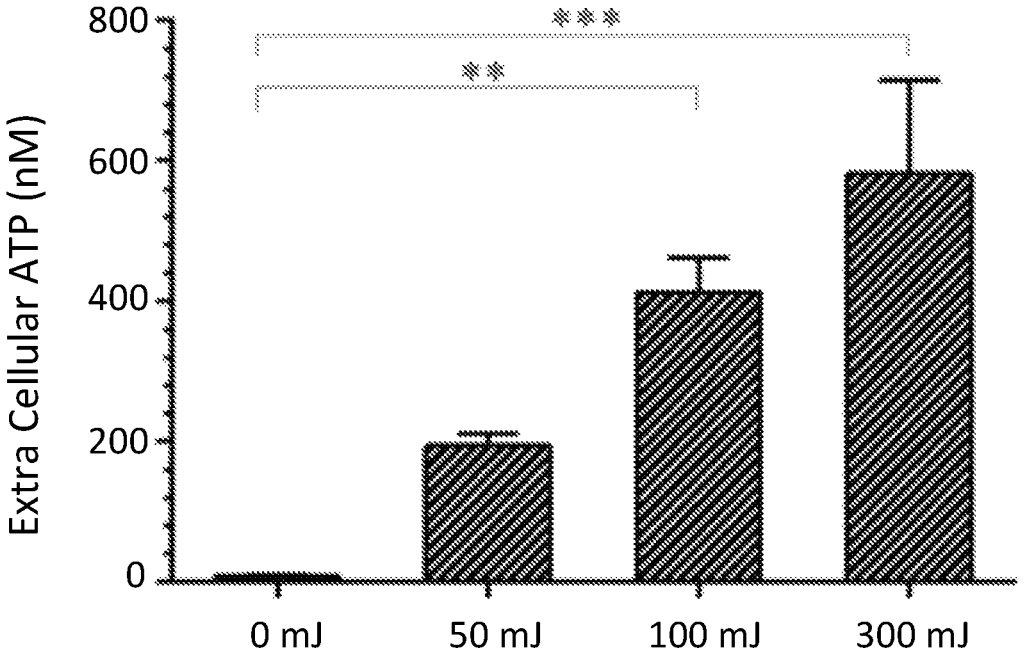

ATP, the most abundant intracellular molecule required for metabolism, is secreted from cells undergoing ICD. [68] It has been suggested that secretion of ATP follows overlapping pathways with externalization of CRT. [69] Once ATP reaches the extracellular space, it becomes another hallmark of ICD and functions as a 'find me' DAMP signal for recruitment and activation of APCs. [69-71] To detect this secreted DAMP signal by cells exposed to plasma, the cell culture media was collected 10 minutes after treatment and extracellular ATP was quantified. ATP levels were low at baseline (8.2 nM) and increased 70-fold (582.1 nM) following 300 mJ plasma treatment (FIG. 7D).

EXAMPLES

The following examples are illustrative, but not limiting of the methods and compositions of the present disclosure.

A microsecond-pulsed high voltage power supply with an output of 20 kV peak-to-peak, a pulse duration of ~8 μs (FIG. 1A), and a frequency of 500 Hz [31] was employed. Plasma jets were generated in He flow (99%, Airgas). To monitor the discharge development and propagation of ionization waves a 4 Picos ICCD camera from Stanford Computer Optics triggered using a P6015A high-voltage probe (75-MHz bandwidth, Tektronix) was connected to a 1-GHz DPO-4104B oscilloscope (Tektronix).

Figure 1B:
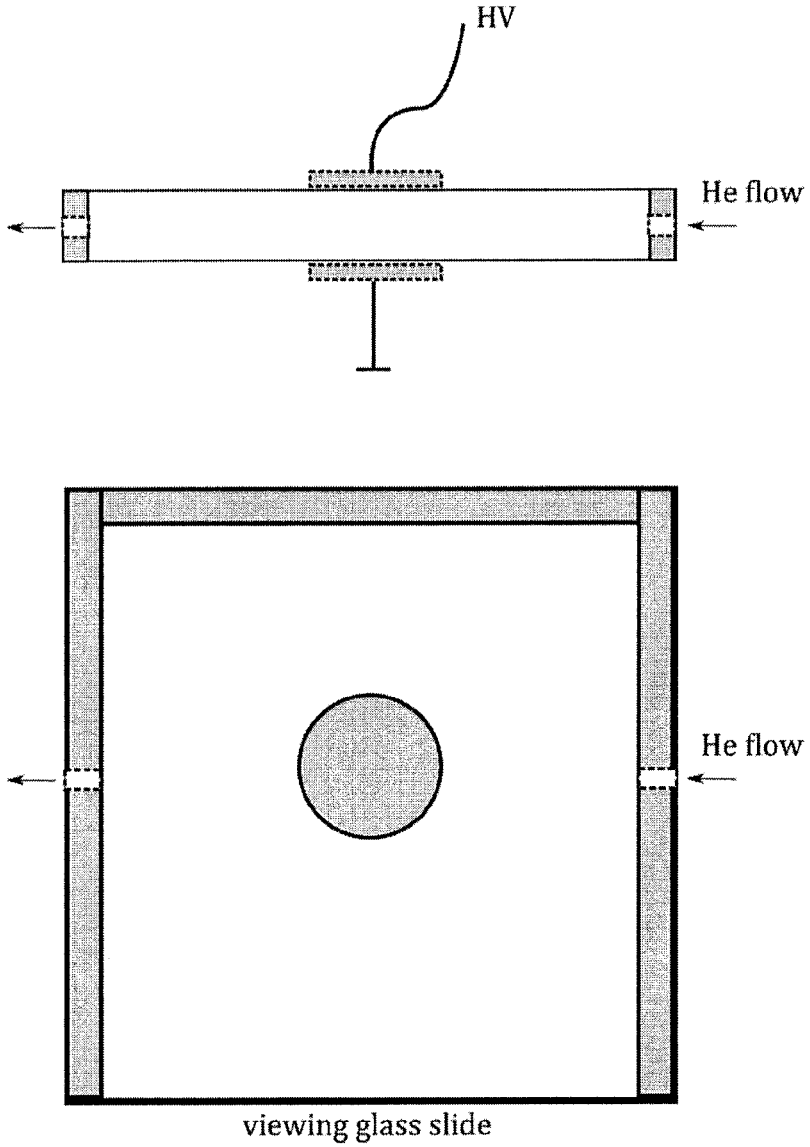
FIG. 1B is a schematic representation of a discharge chamber for visualization of surface ionization wave development and propagation.
Figure 1C:
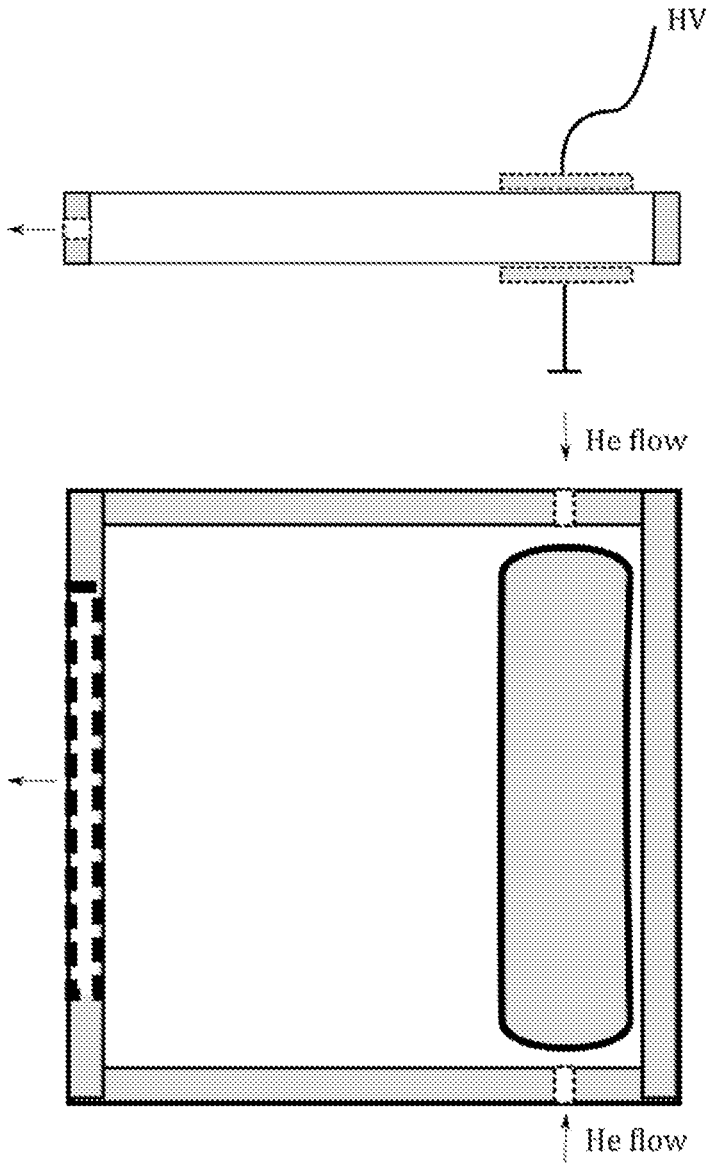
FIG. 1C is a schematic representation of a discharge chamber for generation of rectangular plasma jet.
Figure 1D:
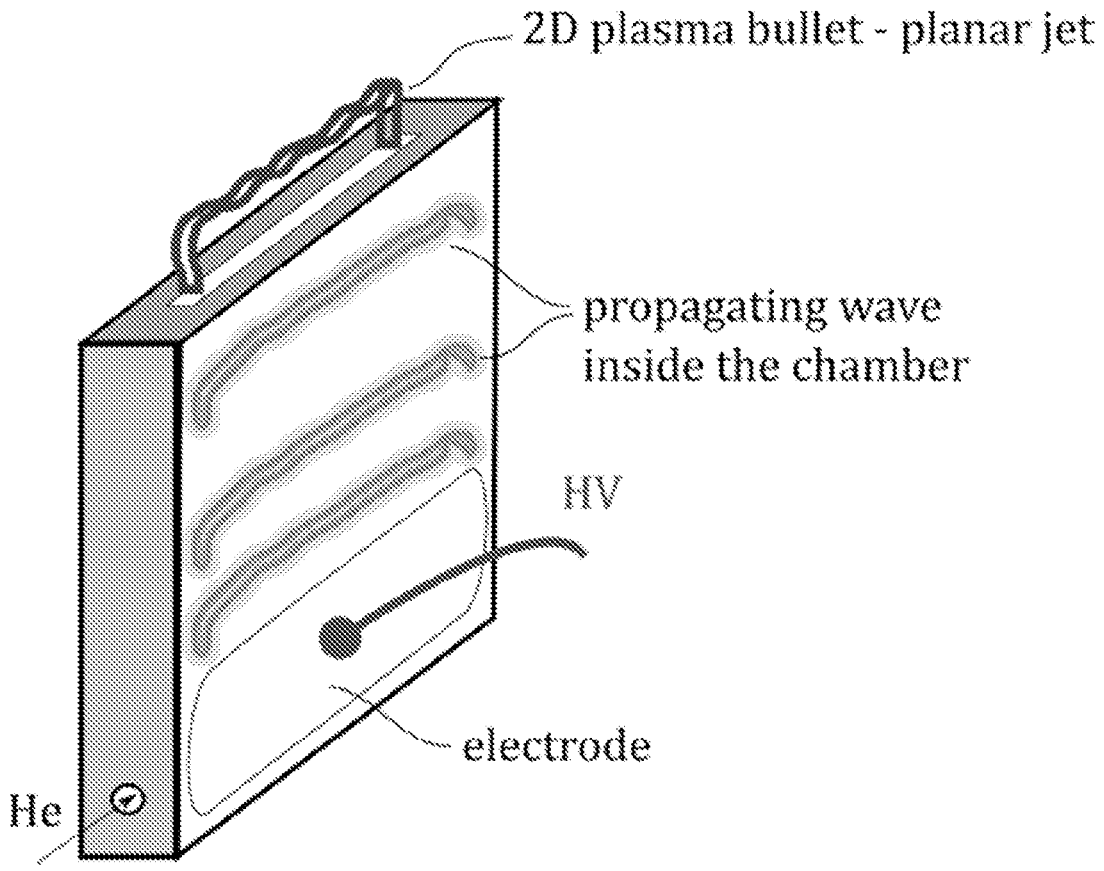
FIG. 1D is a drawing of a device for generating a rectangular plasma jet.

Two different discharge chambers were used for generation and imaging of DBD, surface ionization waves, plasma "bullets" and a rectangular plasma jet. Both chambers were made of two 1 mm thick 75×75 mm glass slides separated by a 5 mm thick dielectric to form a rectangular cuboid with a cavity therein. The first setup, used to study DBD development and propagation of surface ionization waves, employed a 1 mm thick glass slide glued on the side of the chamber to visualize the discharge from the side (FIG. 1B). Two 20 mm in diameter electrodes were fixed in the center of the glass sides of the chamber, and two 2 mm holes were provided as inlets for He flow though the cavity at ~0.5 L/m. To demonstrate possibility of reconfiguring the 1D APPJ into a rectangular plasma jet, a second discharge chamber employed a 1.5 mm wide and 6 mm long slit as an outlet instead of a circular gas outlet. 60 mm long and 20 mm wide copper electrodes were fixed on the outer surfaces of the glass slides (FIGS. 1C and 1D). Gas was supplied through the two 2 mm inlet holes at rate of ~5 L/m.

Figure 2:
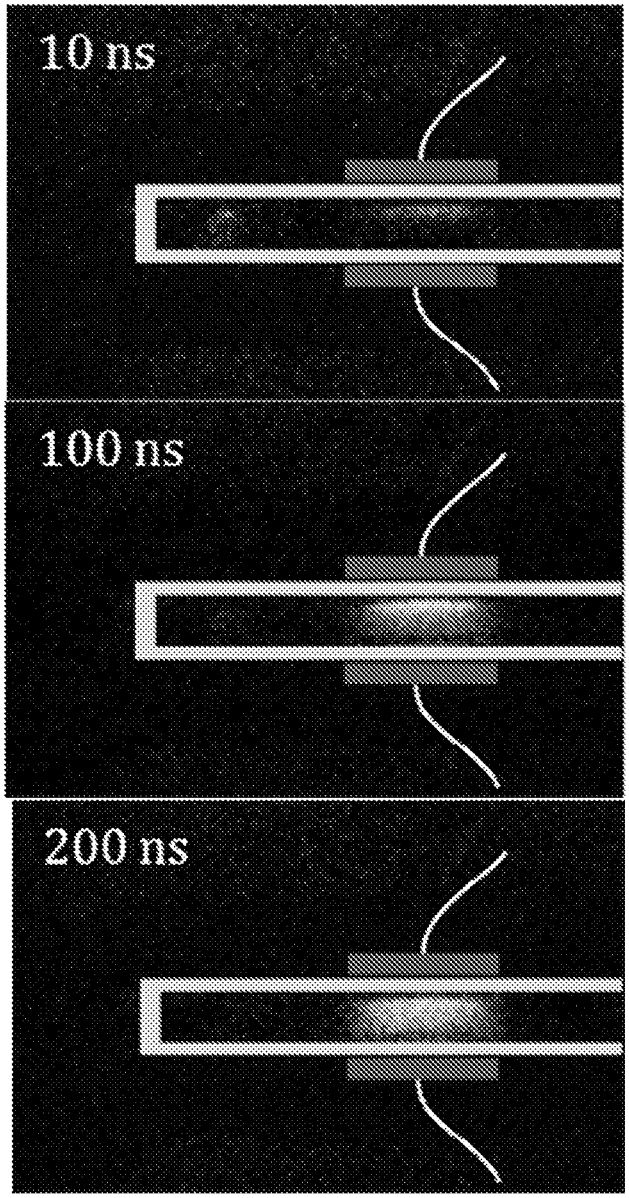
FIG. 2 shows the development of dielectric barrier discharge (DBD) in helium using single exposure ICCD images (false color) taken with 10 ns exposure time and indicated delay time after the trigger (when high voltage pulse reaches ~5 kV). The faint glow seen on the first image in the left region of the chamber is an imaging artefact.

A fast imaging technique using an ICCD camera triggered by the high voltage pulse was used. Since during the high voltage pulse the discharge reignites several times (a series of breakdowns), the camera was focused only on the first illumination that appeared. At first, the DBD starts with development of a series of avalanches traveling from the grounded electrode towards the powered anode. As the avalanches reach the anode, the presence of the dielectric causes accumulation of the charge leading to generation of electron densities (and local electric fields) sufficient for formation of a surface discharge that appears as a bright anode glow region (FIG. 2). This anode glow—"pancake"—is generated prior to the volumetric discharge that develops via traditional cathode-directed streamers. This series of events is not limited to the case of a He atmosphere. In fact, similar discharge behaviors can also be seen for atmospheric air nanosecond-pulsed DBD (see, for example, [32]).

Figure 3:
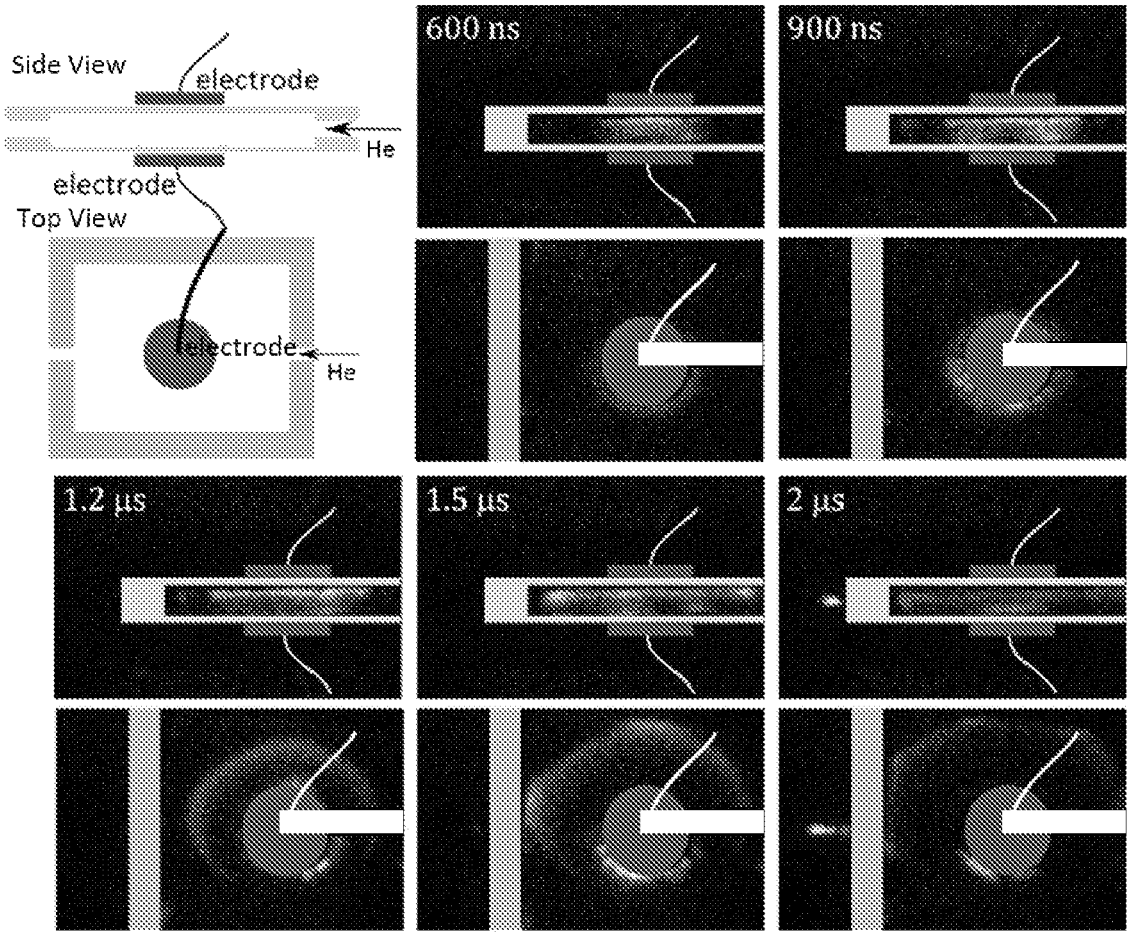
FIG. 3 shows the propagation of surface ionization wave via single exposure ICCD images (false color) taken with 300 ns exposure time and indicated delay time after the trigger (when high voltage pulse reaches ~5 kV). Images are taken separately for the top and side views.

Because the anode glow region can be viewed as a second capacitor (third "electrode" near the anode), high electric fields at its edges facilitate development of a surface wave propagating along the surface of the dielectric. This phenomenon is clearly seen in FIG. 3 as a radially propagating ring with a velocity of ~30 km/s—these images were taken from both the side and top of the discharge chamber. As the wave reaches the output gas hole in the dielectric wall, it exits the discharge chamber in the form of a plasma "bullet". In this experiment, because of the discharge chamber configuration the "bullet" most probably does not have the traditional "donut" shape—unlike in tubular setups, where the ionization wave propagates in the tube along its inner surface and forms a donut shape with a central hole in the ionization wave [3, 33, 34].

Figure 4:
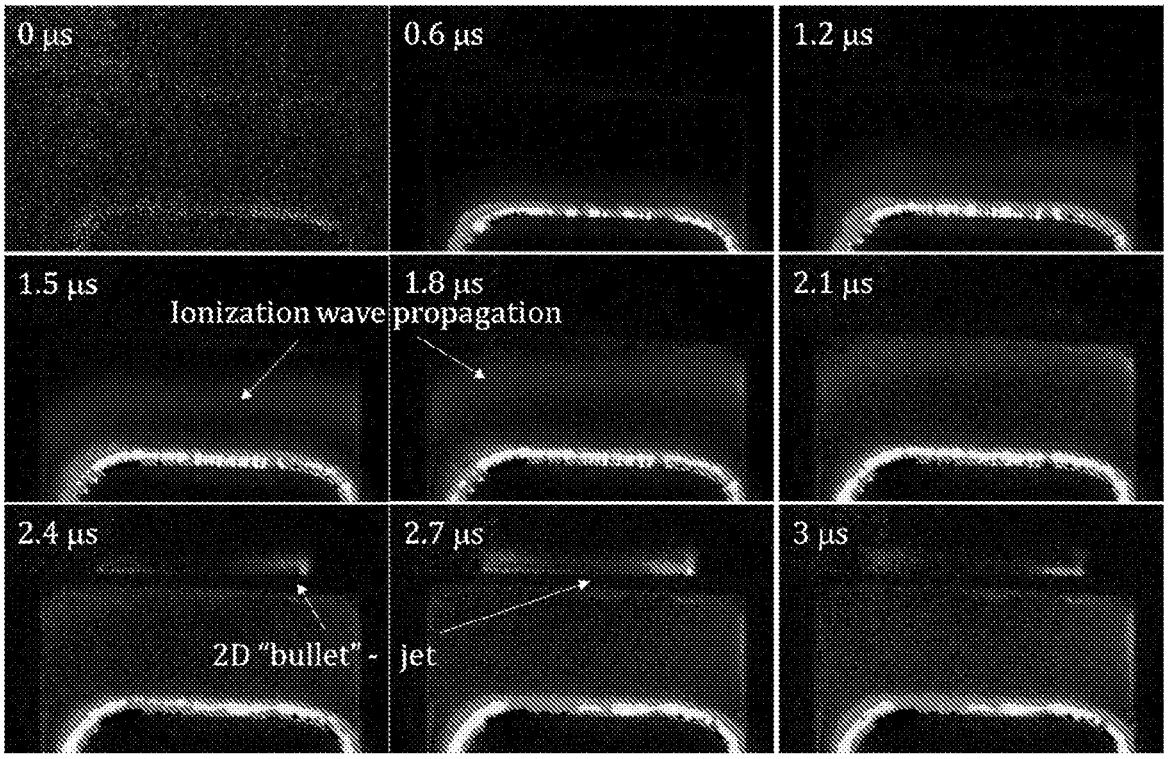
FIG. 4 shows the propagation of a surface ionization wave and formation of a rectangular plasma jet via single exposure ICCD images (false color) taken with 300 ns exposure time and indicated delay time after the trigger (when high voltage pulse reaches ~5 kV).

The relationship between formation of a surface ionization wave in DBD and plasma "bullets" has been shown. This configuration is able to generate a 2D ionization surface wave and thus the inventive configuration of the APPJ is able to generate rectangular plasma jets. For that purpose, the second discharge chamber was used with an exit gas opening in a form of a long rectangular slit. In these experiments, similar to the first case, propagation of the ionization wave inside the chamber along the dielectric surface can be clearly seen (FIG. 4). As the wave reaches the exit opening slit it forms a rectangular plasma jet propagating into the outer atmosphere. In this experiment, likely due to gas flow conditions that cause mixing with air, and a low specific energy input, the propagation length of the jet of this example was ~1 cm or less. The propagation length can be increased by increasing the specific energy input and/or by altering the gas flow conditions to hinder mixing of gas with air after the gas passes through the outlet. For example, higher gas flow rates and/or structural alterations in the shape of the gas outlet can be employed to slow mixing of the gas with air and allow the jet to propagate to distances of 2-5 cm or more. Thus, ensuring a laminar flow through the gas outlet is likely to increase the propagation length by minimizing mixing of the gas with air as the gas exits the gas outlet.

The shape of the output gas opening is not limited to a straight rectangular slit. Rather, the output gas opening can be a more complex shape (for example, a wave-shaped slit). By changing the shape of the outlet gas opening, it is possible to generate plasma jets of various complex 2D or 3D profiles. Similarly, the width of the plasma jet can be controlled by, for example, adjusting the distance of the gas outlet from the electrodes and, in general, is limited only by the magnitude of the pulse energy provided by the power supply. It is possible, therefore, to generate jets with any suitable width to accommodate treatment of large targets.

Figure 5:
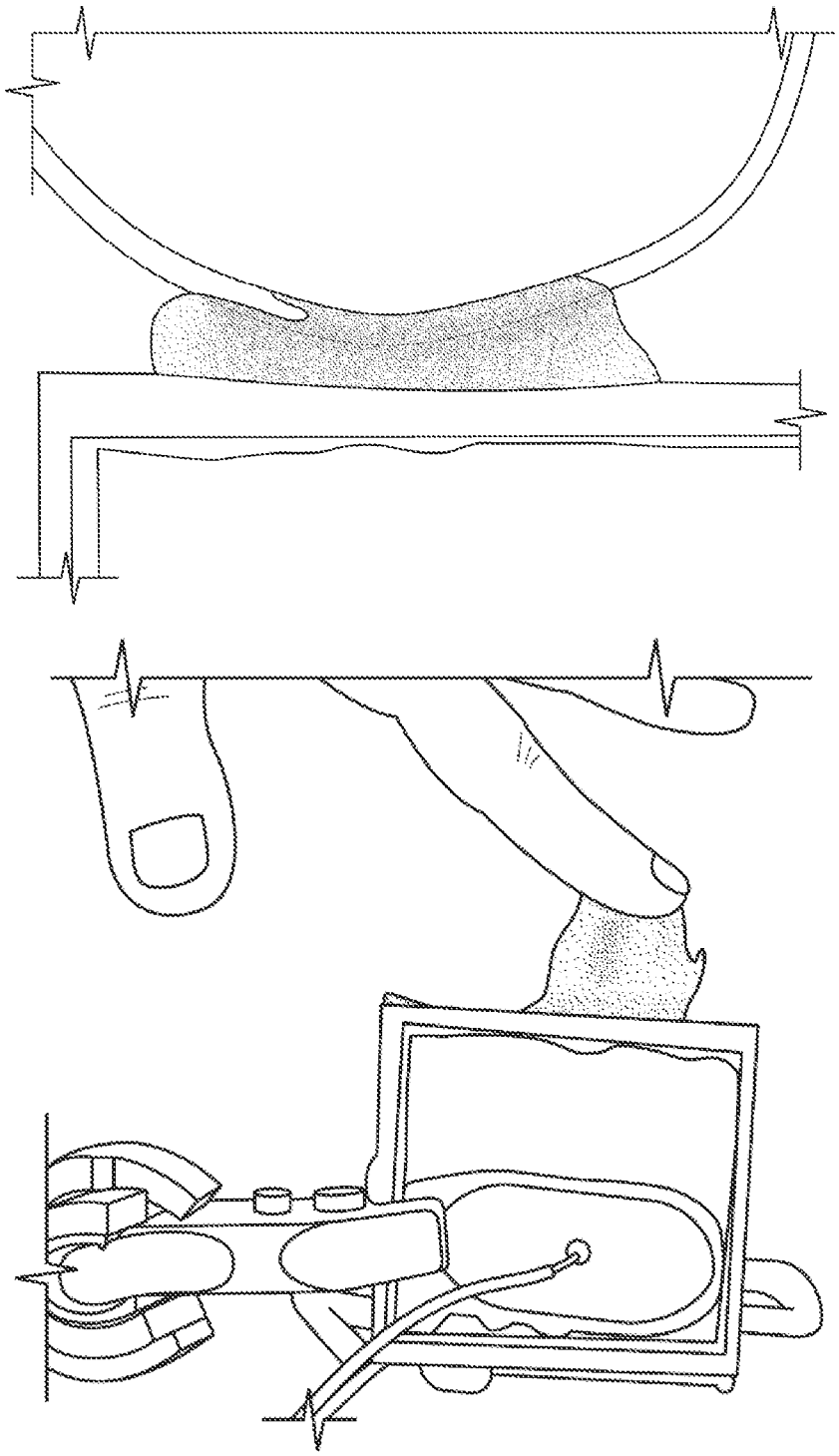
FIG. 5 shows photographs of rectangular plasma jet application to a floating potential insulated wire and to a finger.

Photographs shown in FIG. 5 demonstrate possible applications for treatment—attachment of the jet to a floating insulated wire, and treatment of a finger. Although the distance from the discharge chamber gas outlet to the target varies by from ~0.5-1 cm, the plasma jet still allows for relatively uniform treatment. Also, because of the conductance of tissue (floating potential), the plasma jet can propagate to longer distance when directed at tissue.

In conclusion, it was found that:

1) Evolution of pulsed DBD plasma starts with formation of transient anode glow, and only then continues with development of cathode-directed streamers;
2) In the case of noble gases, the anode glow can propagate as ionization wave along the dielectric surface outside of the discharge gap. For the case of traditional dielectric tubes, the ionization wave appears as a "plasma bullet", often with characteristic "donut" shape;
3) Propagation of plasma "bullets" is not limited to 1D geometry (tubes), and can be carried out in a form of a rectangular jet, or other 2D or 3D shapes.
4) The size of the of the 2D or 3D plasma jets is dictated by the pulse energy and gas flow characteristics.

Plasma jets with complex 2D or 3D geometries open new possibilities in the areas of large surface material processing and plasma medicine.

Figure 8A:
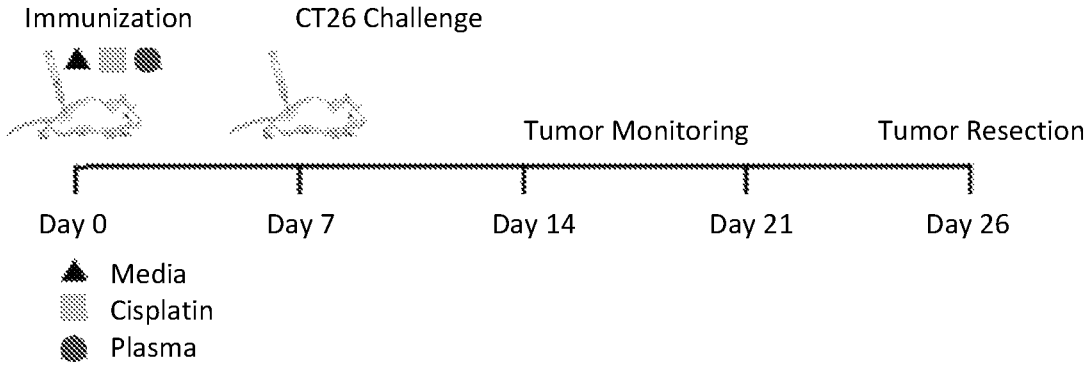
FIGS. 8A-8F show the immunization of mice with cancer cells plasma-treated at ICD-inducing regimes reduce the growth rate in the challenge tumor.

Vaccination with Plasma-Induced ICD Cells Provides Protection Against Tumor Challenge in Mice To ascertain whether the DAMP signals elicited by plasma could enhance immune responses against cancer, a vaccination assay was performed. Balb/c mice were immunized with CT26 cells treated in vitro with plasma at the ICD-inducing regime (29 kV, 30 Hz, 1 mm gap distance, 10 seconds). Cells were prepared for inoculation and injected into the left flank as a whole-cell vaccine to allow an immune response to develop. One week after immunization, mice were challenged with live CT26 cancer cells on the opposite flank and tumor growth was monitored twice a week until day 26 when the study was terminated as a subset of the animals reached IACUC-approved endpoints (FIG. 8A). CT26 cells treated with media only or Cisplatin (50 μM for 24 hours), a non-ICD inducer, [60] were used as controls.

Figure 8B:
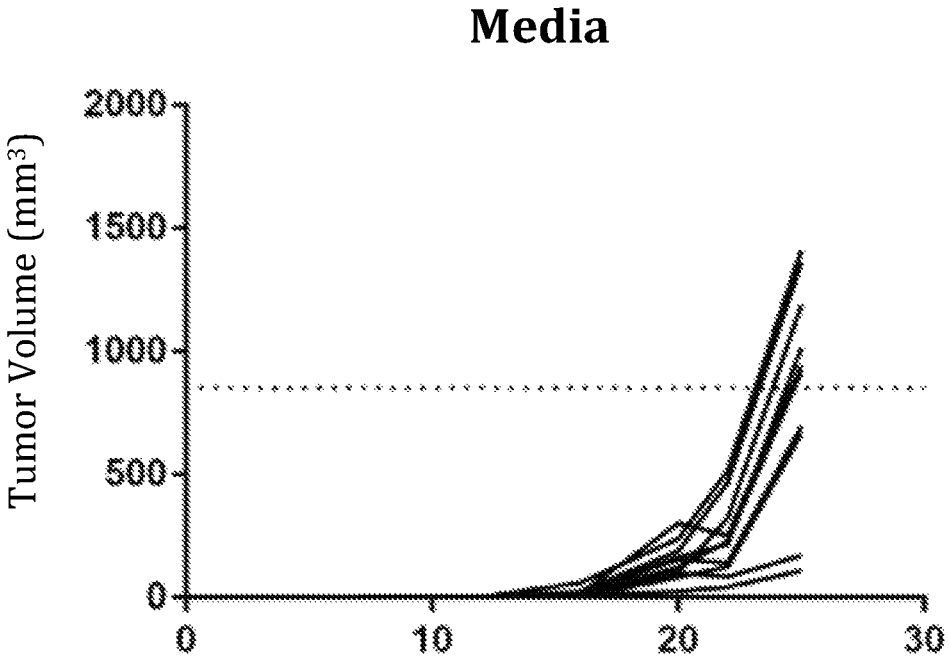
Figure 8C:
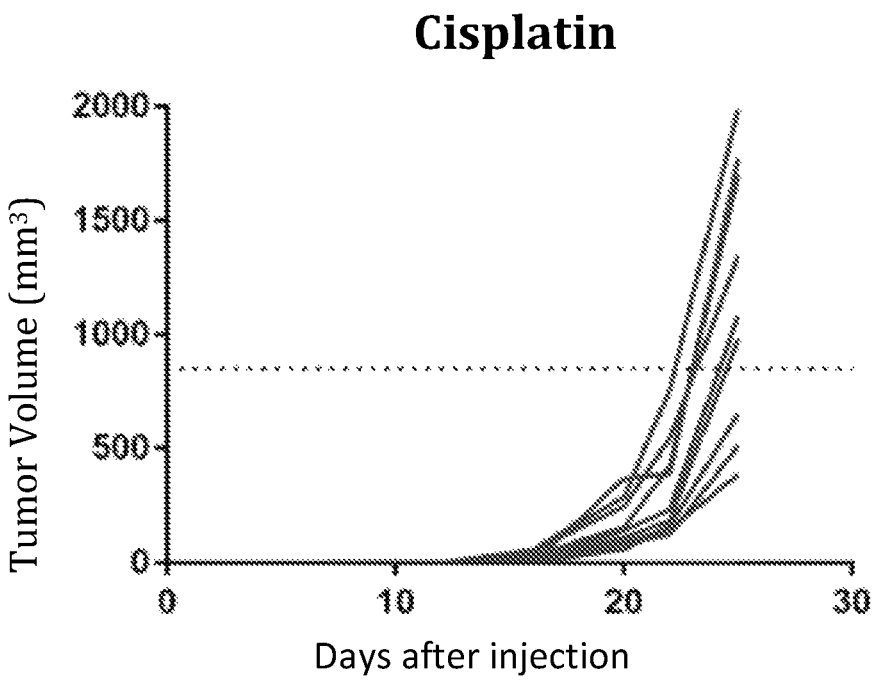
Figure 8D:
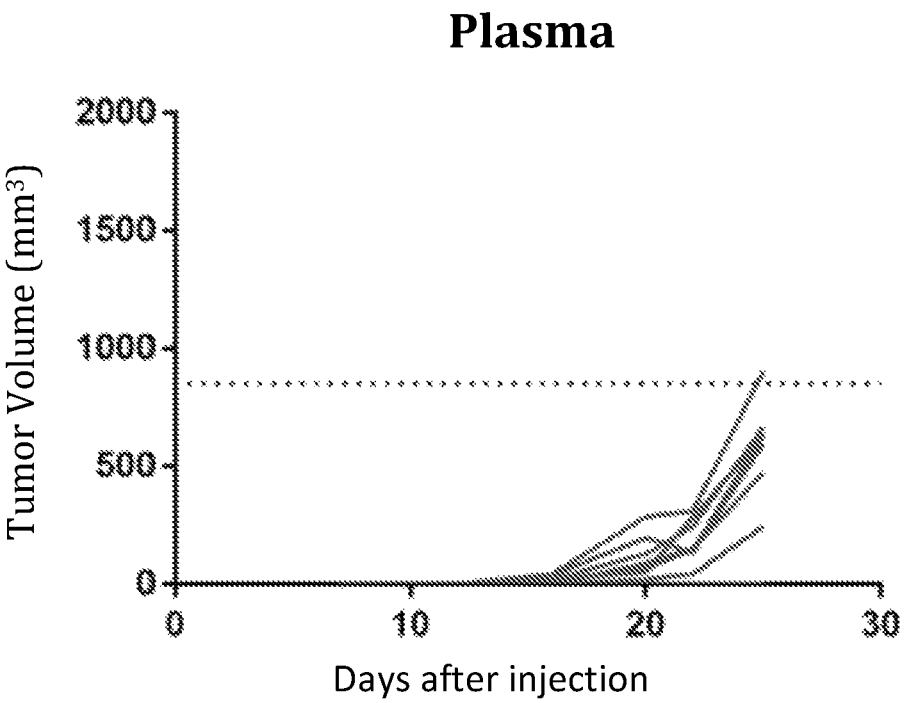
Figures 8E, 8F:
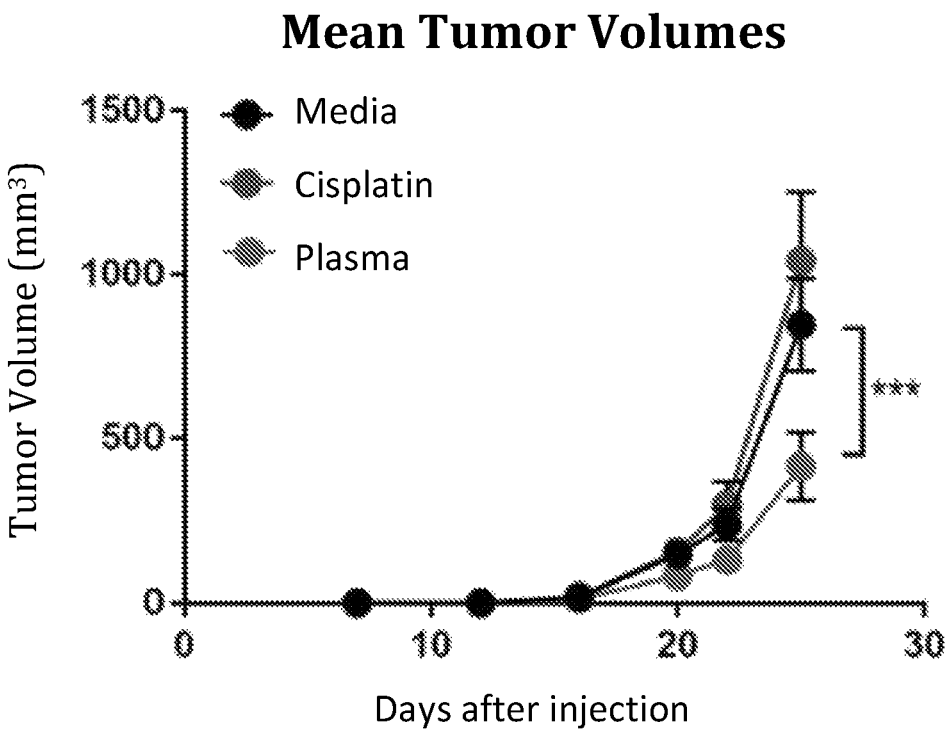

Challenge tumors in the media and Cisplatin groups grew rapidly while tumors in the plasma group developed relatively slowly (FIGS. 8B-8D). The mean tumor volume for the plasma immunized group was significantly smaller compared to that of the media group (414.7±104.3 $mm^3$ vs 847.4±141.5 $mm^3$; $p<0.001$) or the Cisplatin group (1041.8±208.3 $mm^3$) at day 26 (FIG. 8E). Indeed, 90% of the mice in the plasma immunized group had tumor volumes smaller than the mean tumor volume of the media group (850 $mm^3$), suggesting that these mice were partially protected by vaccination. Moreover, 3 out of the 10 mice in the plasma group did not develop subcutaneous tumors at the challenge site (FIG. 8F).

Plasma Induces ICD In Vivo and Stimulates Immune Cell Recruitment

Figure 9A:
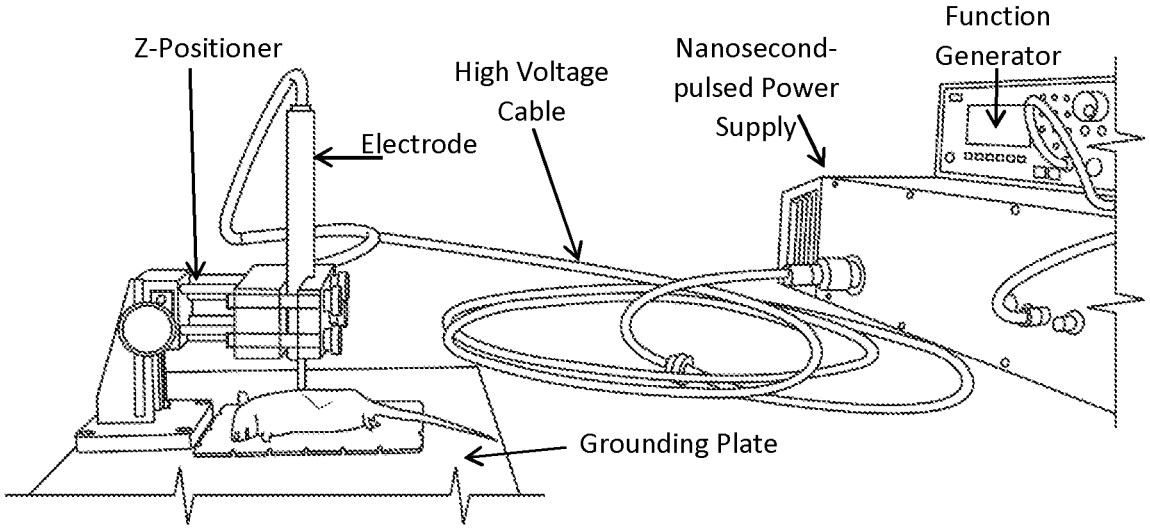
FIGS. 9A-9B show an in vivo plasma treatment system.
Figure 9B:
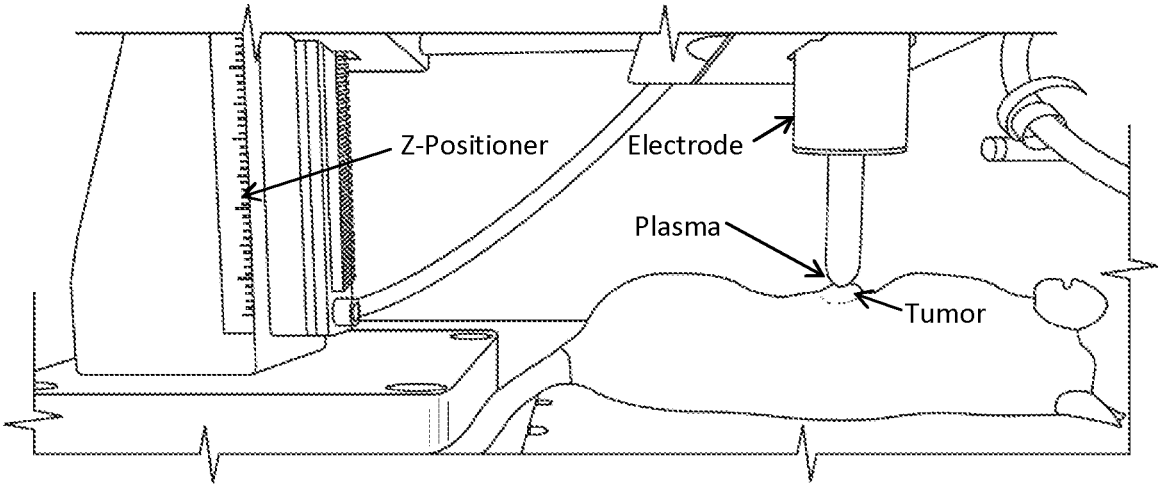
Figure 10A:
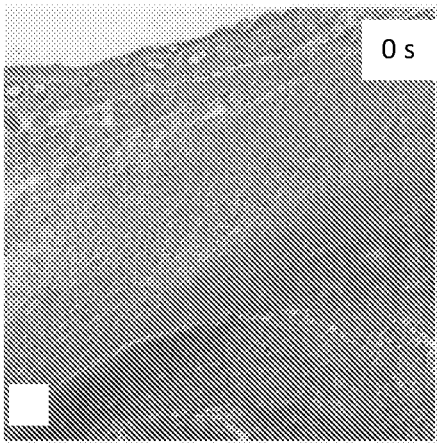
FIGS. 10A-10H show H&E staining of plasma-treated subcutaneous tumors.
Figure 10C:
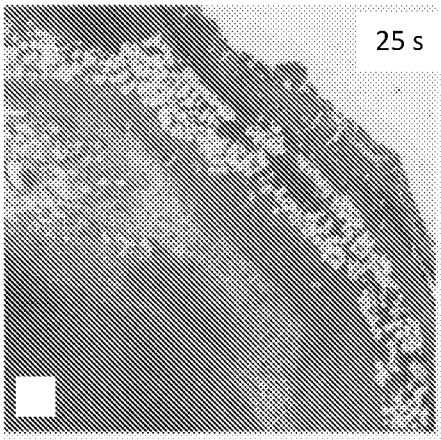
Figure 10B:
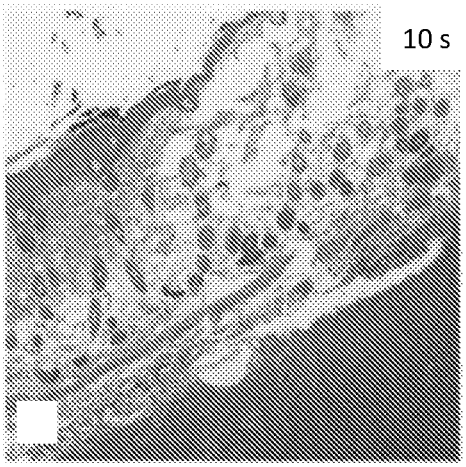
Figure 10D:
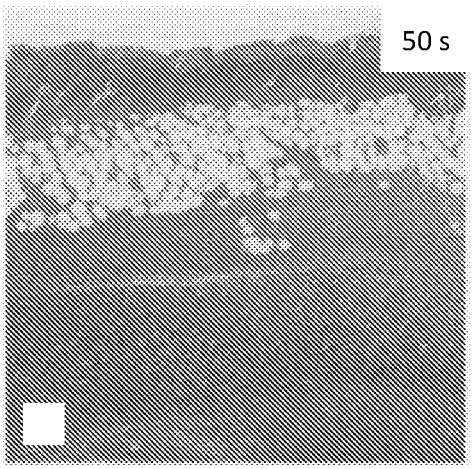
Figure 10E:
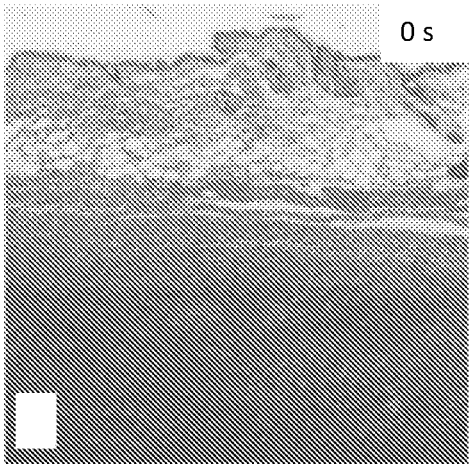
Figure 10G:
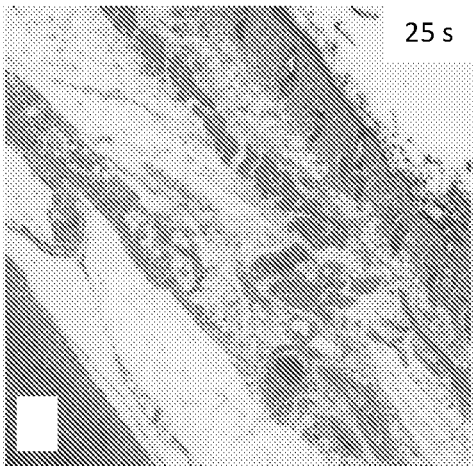
Figure 10F:
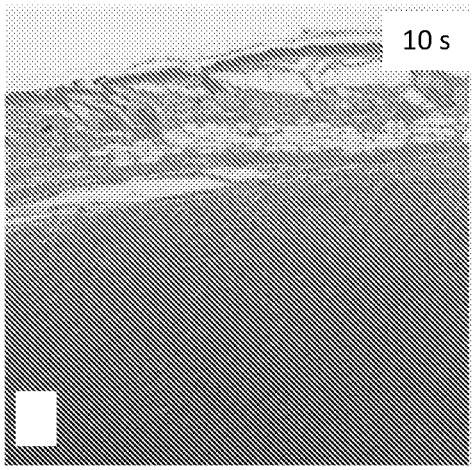
Figure 10H:
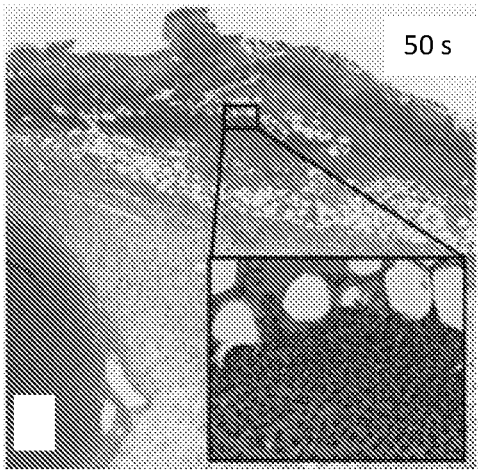

To directly validate whether plasma could induce ICD in vivo, CT26 colorectal tumors were established subcutaneously in Balb/c mice and exposed to plasma when they became palpable (FIG. 9). A safe operating plasma regimen was first identified by exposing subcutaneous CT26 tumors in Balb/c mice to plasma for various treatment times (10, 25, 50 sec) at set plasma parameters (29 kV and 750 Hz) once daily for five consecutive days. One day and 3 days after the final treatment, tumors were resected with overlaying skin, fixed, and stained with hematoxylin and eosin (H&E) staining to assess the structural changes in the dermal and epidermal layers of the skin. Ten seconds of plasma treatment resulted in minimal epidermal damage but no changes to the tumor were observed (FIGS. 10B and 10F)). When plasma treatment duration was increased to 25 seconds, thermal and necrotic damage in the epidermis was observed one day after plasma (FIG. 10C) but not in the underlying tumor. By the third day after treatment, the epidermis appears improved but not fully healed, suggesting that the damage was reversible (FIG. 10G). The 50-second treatment resulted in considerable damage through all the layers of the skin, and, in fact, tumors just below the skin showed thermal and necrotic damage (FIG. 10D). By the third day thermal damage was still apparent and changes in collagen had begun to appear. There were also more neutrophils in the skin signifying an inflammatory response (FIG. 10H).

Figure 11A:
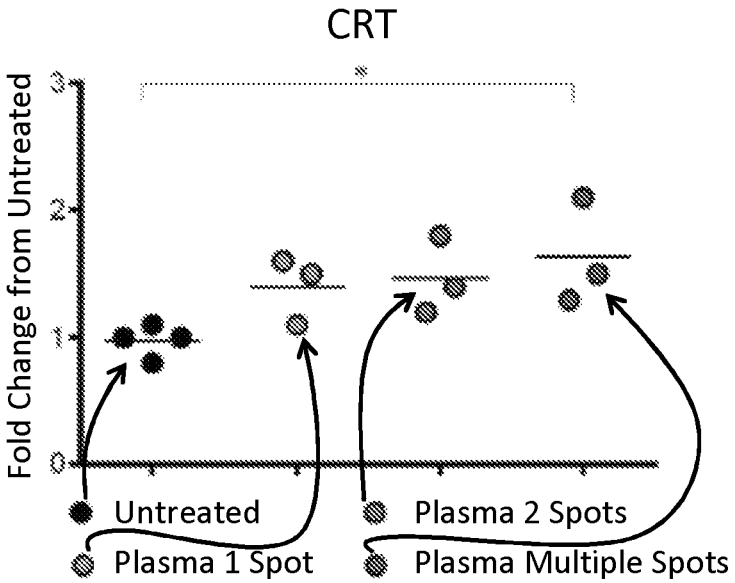
FIGS. 11A-11E show plasma treatment of subcutaneous tumors in Balb/c mice induced DAMP emission and increased leukocytes and APCs in the tumor 3 days after final treatment. Tumor sections were fixed, stained, and imaged by fluorescence microscopy. Fluorescence intensity of representative sections of the tumor were quantified with ImageJ and normalized to untreated controls.
Figure 11B:
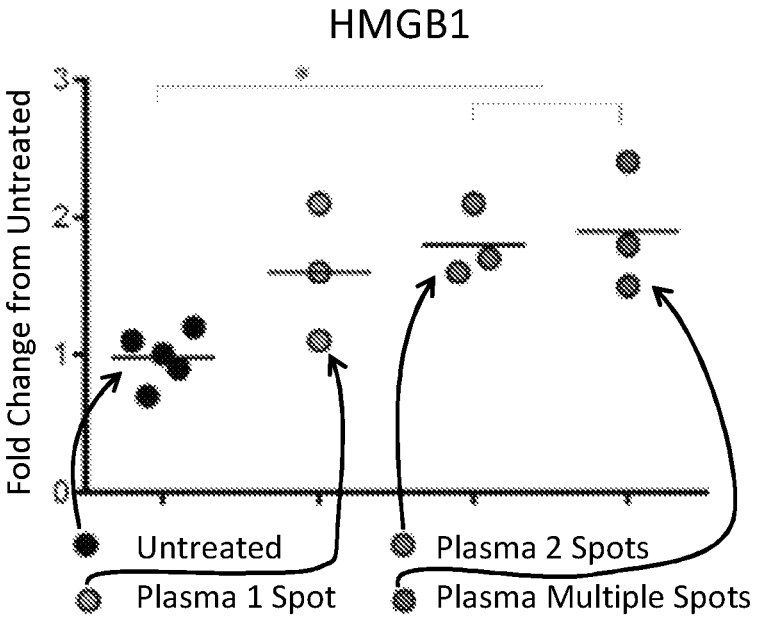

Based on the results of these safety studies, the 10 second plasma treatment over five days was investigated to determine if it induced ICD in the subcutaneous tumors. Tumors were exposed to plasma using three different treatment procedures: i) the same area each day (Plasma 1 Spot), ii) two areas of the tumor each day (Plasma 2 Spots), or iii) different areas of the tumor each day (Plasma Multiple Spots). Three days after the last plasma treatment, tumors were resected, fixed, and sectioned. Immunofluorescence microscopy was performed on tumor sections to identify ICD markers. CRT expression increased in all plasma treatment groups (FIG. 11A) and was maximum following the "Plasma Multiple Spot" regimen (1.6±0.2 fold, $p<0.05$). Tumor sections were also stained for High mobility group box 1 (HMGB1), another DAMP signal much like ATP, that recruits inflammatory immune cells and mediates signals between APCs. [72-75] HMGB1 has been observed to translocate from the nucleus to the cytoplasm and extracellular space. [74-76] Here, an increase in immunofluorescence intensity of HMBG1 was observed in all plasma treatment groups (FIG. 11B), suggesting HMGB1 protein concentration may be elevated following plasma exposure.

Figure 11C:
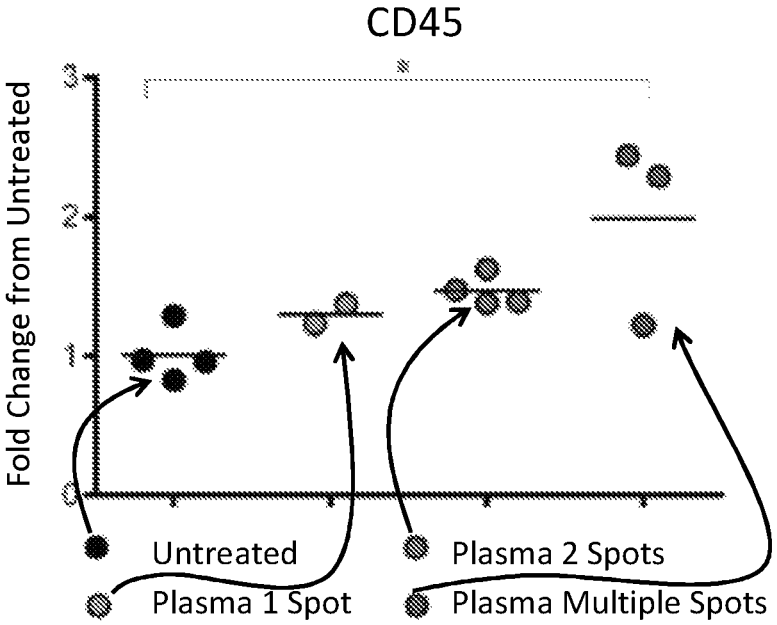
Figure 11D:
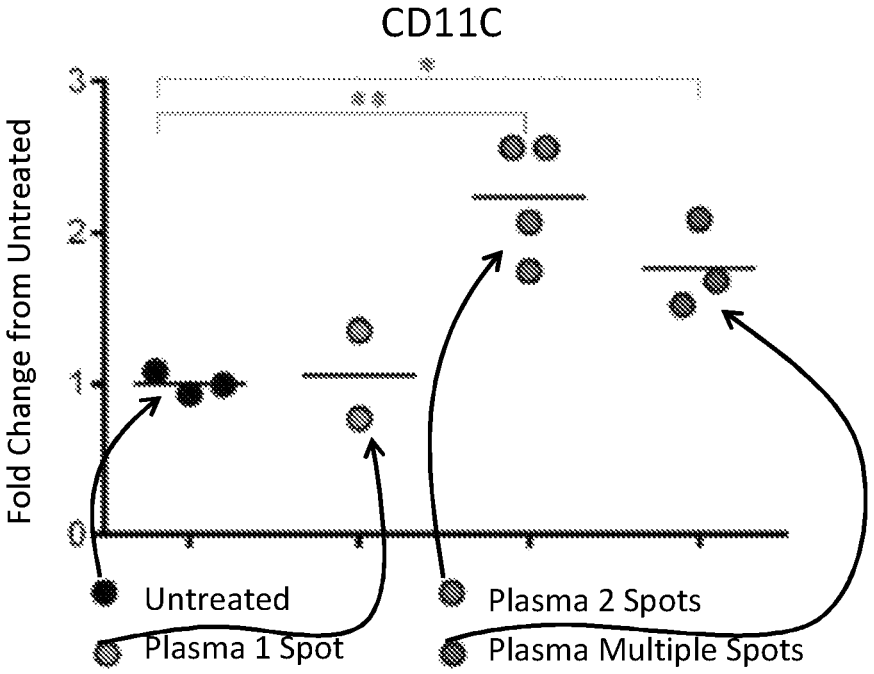
Figure 11E:
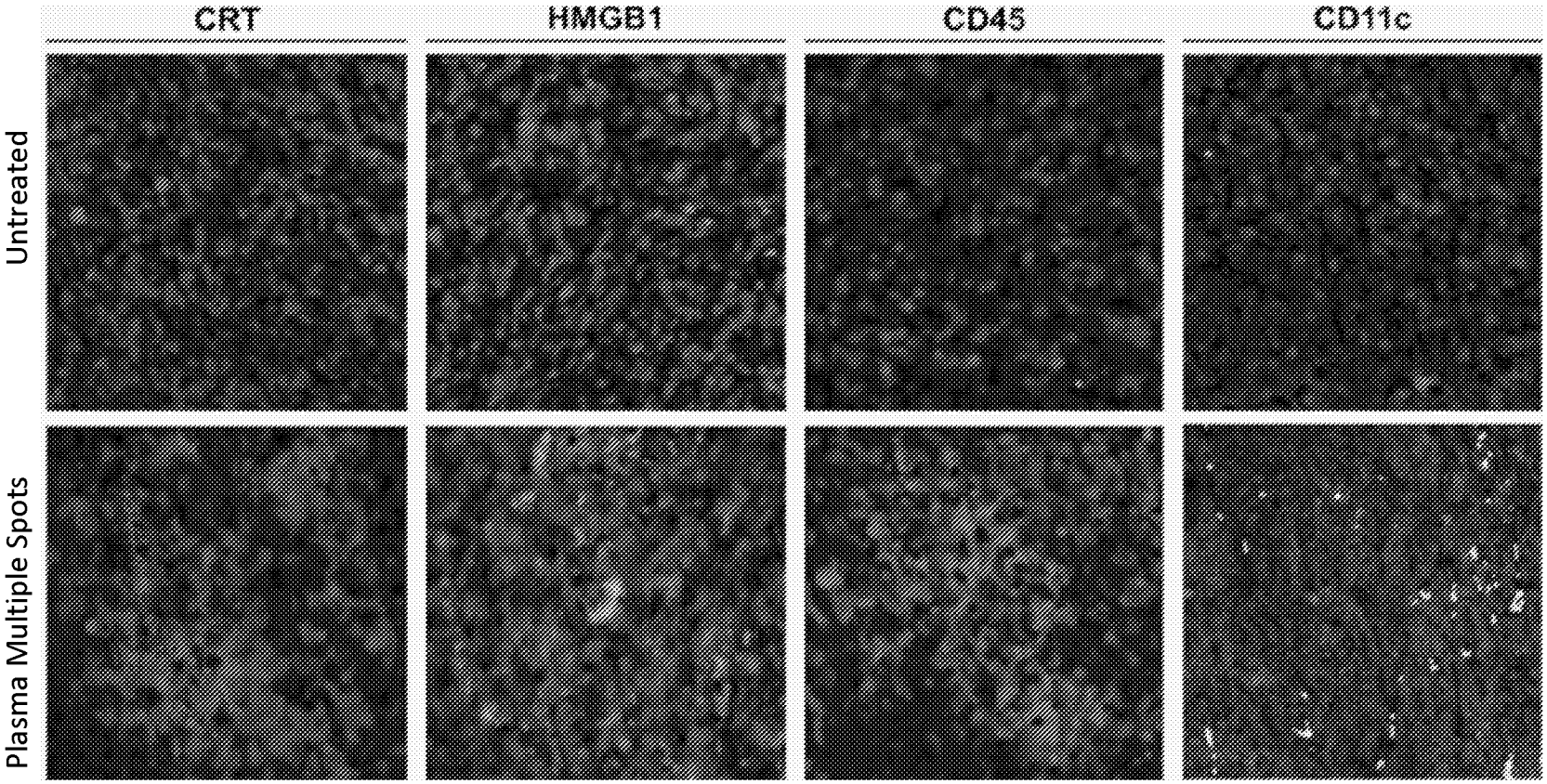

To determine if emitted DAMPs stimulated the recruitment of immune cells into the tumor environment, the sample was stained for CD45+ (leukocytes) and CD11c+ (APCs) immune cells. Indeed, increased CRT and HMGB1 were associated with more CD45+ (2.0±0.4 fold, $p<0.05$) and CD11c+ cells (1.8±0.2 fold, $p<0.05$) following the Plasma Multiple Spots regimen (FIGS. 11C and 11D). Because CD45 is expressed by all leukocytes, including T cells, B cells, neutrophils, NK cells and others, [77-78] it is possible that other immune cell subsets are also being recruited as a downstream consequence of ICD induction. Representative immunofluorescence images of the multi-spot treatment compared to the untreated are shown in (FIG. 11E).

Altogether, Plasma Multiple Spots treatments enhanced both emission of DAMPs and recruitment of immune cells in the tumor compared to the other application methods. Therefore, treatment of different spots may be more beneficial compared to repeat treatment of the same area. This treatment condition was used to investigate plasma-induced ICD effects on downstream T-cell response.

Plasma Amplifies Specific T-Cell Responses Against CT26-GUCY2C Tumors

Figure 12A:
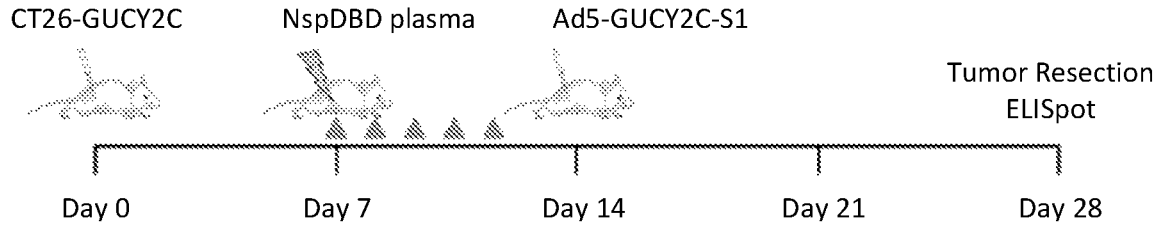
FIGS. 12A-12C show use of plasma in combination with vaccination enhanced cancer-specific T-cell responses.

To analyze whether plasma-induced ICD could stimulate an adaptive anti-tumor response, subcutaneous CT26 tumors expressing the colorectal cancer antigen GUCY2C42,43 (CT26-GUCY2C) in Balb/c mice were treated. Mice were treated with either plasma alone or with plasma in combination with the Ad5-GUCY2C-S1 vaccine. The Ad5-GUCY2C-S1 vaccine was previously shown to safely induce GUCY2C-specific immune responses and antitumor immunity in mice [81-88] and has been translated to human clinical trials. [89] Mice were treated with plasma for five consecutive days and one group was vaccinated with the Ad5-GUCY2C-S1 vaccine, one week after the last plasma treatment (FIG. 12A). An untreated group and a vaccine only group (Ad5-GUCY2C-S1 vaccination) served as our negative and vaccine controls, respectively.

Figure 12B:
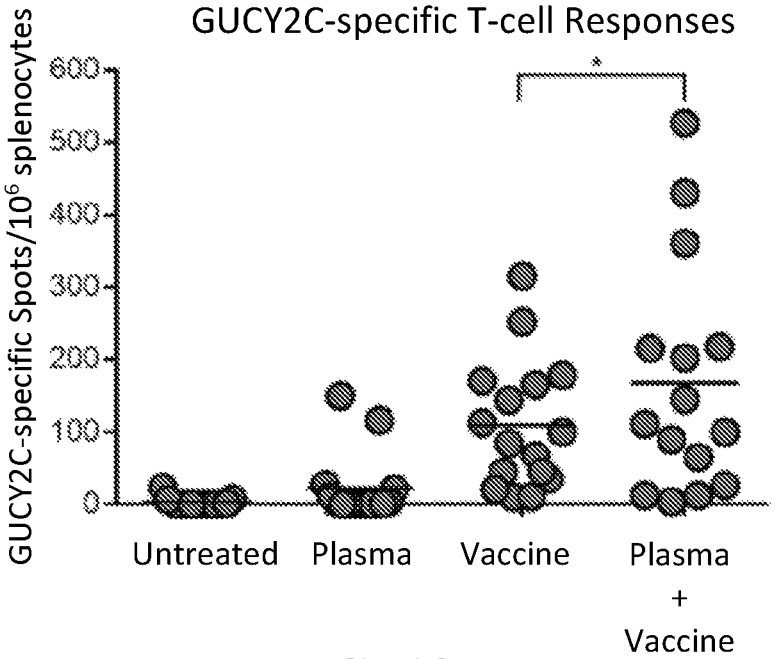

Splenic GUCY2C-specific T-cell responses were analyzed by IFNγ ELISpot assay 28 days after the initial tumor inoculation. Plasma treatment alone had a marginal effect on GUCY2C-specific responses (22.1±11.9 spots vs 3.0±1.8 spots in Untreated; p=ns). However, plasma treatment prior to vaccination amplified GUCY2C-specific T-cell responses (167.8±41.5 spots vs 109.7±22.3 spots with vaccine alone, $p<0.05$) (FIG. 12B). This observation supports the potential of plasma to increase the immunogenicity of cancer cells and stimulate canonical pathways required for tumor control. Typically, immune responses are generated against one or two dominant epitopes of an antigen. When the specificity of immune responses spreads to include subdominant epitopes, new populations of T cells may be generated against the antigen. [90-91] It was tested whether plasma and vaccination treatment exposes neoantigens unrelated to the original vaccination target, GUCY2C.55 T-cell responses against AH1, an endogenous immunodominant MHC class I-associated epitope from gp70 expressed by CT26 tumor cells (FIG. 12C) were measured. [92-94] Mice receiving both plasma and peptide vaccine exhibited a modest increase in the AH1-specific T-cell response (24.2±8.3 vs 11.0±4.3 spots; p=ns). Epitope spreading was observed. Further optimization of plasma treatment to alter tumor microenvironment is expected to produce conditions even more favorable for epitope spreading. The foregoing data provides compelling evidence that plasma acts as an adjuvant for cancer therapy as shown by the amplification of GUCY2C-specific and AH1-specific T-cell responses in mice. Increased efficacy with the addition of vaccine suggests that plasma may prime the host's immune system and may allow for its use in other combination therapies.

Although significant advancement in conventional tumor-targeted cancer therapies (e.g. surgery, chemotherapy, radiation therapy, etc.) has reduced cancer related morbidity and mortality, this comes at the cost of significant toxicity. Another major challenge is relapse from cells that escape treatment and eventually develop resistance to therapy. [95-97] In contrast, immunotherapy aims to activate the patient's natural defenses to selectively target tumors for resolution of cancer [97-100] with reduced non-specific damage to normal tissue. While current strategies (e.g. adoptive T-cell transfer, checkpoint inhibitors, etc.) are clinically efficacious, several instances of serious adverse effects, including pneumonitis and enterocolitis, have been reported. [101-102] To address these, an ICD-mediated immunotherapy approach may be employed. These treatments stimulate the release of DAMP signals in cancer cells which engage APCs to expose neoantigens and facilitate the initiation of adaptive immune responses. [103-104] The methods to induce ICD include certain chemotherapeutic agents, irradiation, photodynamic therapy with hypericin (PDT-hypericin), and high hydrostatic pressure. [105]

It has been demonstrated that non-thermal plasma may be operated for ICD induction and utilized in immunotherapeutic strategies. In vitro, nspDBD plasma elicited CRT emission and secretion of ATP from CT26 colon carcinoma cells. The vaccination study showed that mice immunized with cancer cells treated with ICD-inducing plasma were partially protected against tumor challenge. In agreement with in vitro studies, in vivo plasma treatment of subcutaneous tumors in mice induced immunogenic cancer cell death. The treatment of multiple spots within the tumor elicited the greatest emission of DAMPs and recruitment of APCs into the tumor area. This treatment condition also led to a tumor-antigen-specific T-cell response.

Overall, these results highlight the potential of plasma development for cancer immunotherapy. Further optimization of plasma parameters (applied voltage, pulse frequency, application time, etc.) and treatment schedules is improve efficacy. It has been reported that antitumor effects of plasma are associated with plasma-generated RONS, but the link to immunogenic cell death has not been made. [53] In vitro, RONS produced by plasma were demonstrated to be the major effectors for eliciting ecto-CRT and ATP secretion in cancer cells, although potential synergy with the associated pulsed electric fields or UV radiation should not be discounted. [60] In 2018, a comprehensive review on the molecular mechanisms of cell death was published by the Nomenclature Committee on Cell Death (NCCD). [106] Twelve major cell death subroutines (intrinsic apoptosis, extrinsic apotosis, mitochondrial permeability transition (MPT)-driven necrosis, necroptosis, ferroptosis, pyroptosis, parthanatos, entotic cell death, NETotic cell death, lysosome-dependent cell death, autophagy-dependent cell death, and immunogenic cell death) were defined from morphological, biochemical, molecular, and functional perspectives. To date, six DAMPs have been linked with cell death that is immunogenic [CRT, ATP, HMGB1, type I interferon (IFN), cancer cell-derived nucleic acids, and annexin A1], but not all the underlying mechanisms are clear, and some are dependent on the specific ICD-inducer. [107-113]

The scheduling of plasma treatment will also influence clinical outcome, as plasma may also induce bystander effects on other resident or recruited cells in the tumor environment (e.g. macrophages, dendritic cells, effector T cells, etc.). Indeed, in a separate study where mini pigs were exposed to plasma, recruited myeloid cells were detected in the treated areas of the skin one week later, [114] suggesting that local plasma exposure may influence immune cells even in the absence of cancer. Furthermore, several studies have demonstrated that within a defined range of treatment parameters, plasma may stimulate immune cell function (e.g. migration, secretion of cytokines, etc.) in vitro. [58 & 115-118] This could potentially provide an advantage over radiation or PDT, known ICD inducers, as they are reported to be detrimental to immune cells. [119-121] An indicator that plasma may be immunomodulatory at physiologically safe doses was reported in a study where *Drosophila* exposure to plasma caused differentiation of hematocytes without affecting development or fecundity of the organism.[122]

For superficial cancers such as melanomas, administration of plasma is relatively straight-forward, as cancerous tumors/lesions are easily accessible for direct deposition of plasma-generated RONS. However, treatment of non-superficial cancers is a challenge for the plasma medicine field. One approach to deliver plasma species to deep tumors is through the use of plasma treated liquid (PTL), [123-124] in which media is treated with NTP to enrich dissolved RONS and injected locally in the tumor or perfused through body cavities.[125-126] Utsumi and co-workers demonstrated that injection of PTL locally into subcutaneous tumors can inhibit growth of malignant tumors in mice though the anti-tumor effects are not as prominent as direct plasma treatment. [126] This is likely due to the instability of plasma-dissolved species in the media and the animals' antioxidant capacity.[127]

A more direct, but invasive approach may involve intra-operative plasma treatment following surgical tumor excision to eliminate cancer cells remaining in the surgical margins. Physicists and engineers are designing different plasma sources and geometries for a less invasive and more focused approach to deliver plasma inside the body. [128-130] Plasma has been shown to propagate along tubes up to several meters in length and with diameters as small as 15 μm. [128-129]. The effectiveness of some of these endoscopic plasma devices is being tested in an in vivo pancreatic cancer model. [130] For successful clinical application with this approach, a detailed understanding of the RONS delivered to the target from the plasma aperture is critical.

Finally, as we show here, immunization with a plasma-created whole-cell vaccine provided protective anti-tumor effects. With optimization of vaccine development and delivery this could be a feasible strategy for plasma-mediated cancer control where plasma acts as an adjuvant.

Figure 12C:
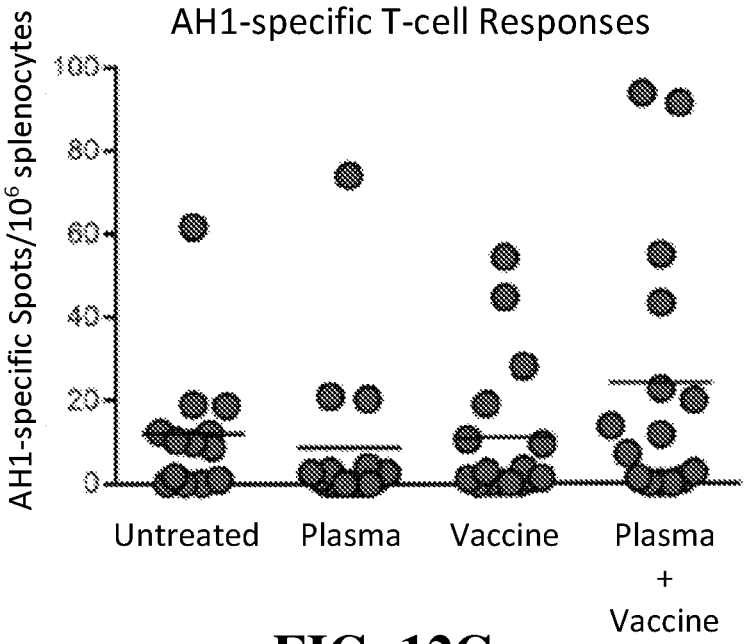

The data suggests that combining plasma with other immunotherapeutic agents may provide additional clinical value (FIGS. 12A-12C). Development of these strategies should be considered based on their effect on the different steps of adaptive immune response progression. [131] For example, plasma-induced ICD could prime the host immune response against tumor antigens, which could be boosted by a targeted vaccine, while checkpoint inhibitor blockade may enhance the therapeutic effect of plasma immunotherapy.

A new paradigm of plasma treatment for cancer may be 'plasma onco-immunotherapy'. [132] This approach not only debulks tumors, but also engages the innate immune system via ICD to initiate adaptive immune responses. [132-133]

NSPDBD Plasma System and Treatment Parameters

Non-thermal plasma was generated in vitro by applying high voltage pulses to a dielectric barrier discharge (DBD) electrode. DBD electrodes used in this study were fabricated with a quartz dielectric covering a copper electrode. This prevents current build-up and creates an electrically safe plasma without heating surrounding gas and tissue. A nanosecond pulser (FPG-20-05NM, FID GmbH, Germany) was used to generate high voltage pulses, characterized in our previous work. [45] The system produced: 29 kV pulses, 2 ns rise times, 20 ns total pulse duration and a 0.9 mJ/pulse.

Cell Culture and In Vitro Plasma Treatment

Colorectal cancer cell line CT26.WT was obtained from ATCC (CRL-2638). Generation of CT26-GUCY2C cells was described previously. [134] Cells were cultured in complete media: DMEM with 10% fetal bovine serum (FBS) and 1% penicillin/streptomycin (Corning Life Sciences, USA). All cells were grown in a humidified environment at 37° C. with 5% $CO_2$ (Panasonic, MCO-19AICUVH-PA, USA). Cells were plated one day prior to plasma treatment in 24-well plates at $3.0\times10^5$ cells/mL (0.5 mL/well). Before treatment with plasma, media was removed from each well and cells were washed twice with phosphate buffered saline (PBS). PBS from the second wash was removed from the well right before cells were exposed to plasma in the absence of any liquid. Fresh, complete media (0.5 mL) was immediately added back into the well following exposure to plasma. For treatment with plasma, a DBD electrode (1.3 cm diameter) was placed 1 mm above cells in the 24-well plate on top of a grounded metal plate with a z-positioner. Since all liquid was removed, plasma was generated in the gap between the electrode and the plate, directly on the cells by applying high voltage pulses from the nanosecond pulser. Treatment time was fixed to 10 seconds, and pulse frequency was controlled by an external function generator (TTi, TG5011LXT, USA). A range of pulse frequencies were used (50, 15, 30 and 75 Hz), and the combination of plasma treatment parameters produced in the following plasma treatment energies: 50, 100, 300 and 700 mJ, respectively. [45]

Mice and In Vivo Plasma Treatment

Balb/c mice were obtained from Jackson Laboratory (USA), and animal protocols were approved by The Thomas Jefferson University Institutional Animal Care and Use Committee. Subcutaneous tumors were established by injecting 1×105 CT26-GUCY2C cells in the flanks of mice, and monitored for growth. Prior to plasma treatment, hair over the tumor area was removed using a chemical depilatory agent to avoid obstruction of plasma generation and treatment. Tumors were treated once daily with plasma beginning on day 7 (for effector T cell development studies) or day 18 (for ICD and recruitment studies) and continued for 5 consecutive days. A smaller DBD electrode (3 mm diameter) was fabricated and used for treatment of mouse tumors. The nanosecond pulser and function generator used for in vitro treatment were also used here. Pulse frequency was adjusted to 750 Hz and treatment time was 10, 25 or 50 seconds. Mice were anesthetized with 5% isoflurane and treated on the grounding plate with the electrode positioned approximately 1 mm above the tumor with the z-positioner. Tumor volumes were monitored by measuring 3 orthogonal diameters and calculated using $43\pi\times r1\times r2\times r3$.

Cell Viability Assay

Cell viability was determined 24 hours after plasma treatment using a Muse Cell Analyzer (Millipore, USA). Cell suspensions were collected, diluted 1:20 with Muse Count & Viability Reagent (Millipore, USA) and analyzed according to the manufacturer's instructions. The percent viability was determined for each sample.

ATP Release Assay

Cell supernatant was collected 10 minutes after plasma treatment and extracellular ATP was measured using a luciferin and luciferase-based chemiluminescent kit (Sigma-Aldrich, USA). All procedures were performed and reagents were prepared following manufacturer instructions. Luminescence value was measured by a Photon-Master luminometer (LuminUltra, USA) which was calibrated with the provided UltraClear calibration solution. The measured relative light units were converted into ATP concentration (pgATP/mL). Data were represented at ATP concentration (nM).

Fluorescence Detection of Surface-Exposed Calreticulin (CRT)

CT26 cells were collected 24 hours after plasma treatment and washed twice with blocking buffer (PBS+1% heat-inactivated FBS). Cells were then incubated with rabbit anti-mouse calreticulin antibody (ThermoFisher Scientific, USA) in blocking buffer (1:200) for 30 minutes in the dark at room temperature. Following incubation, cells were washed twice with blocking buffer and stained with Alexa Fluor 488 conjugated goat anti-rabbit IgG secondary antibody (ThermoFisher Scientific, USA) at 1:500 in blocking buffer. Cells were incubated at room temperature, in the dark, for 40 minutes. Following staining, cells were washed and fixed with 4% PFA and analyzed by FACS.

Anti-Tumor Vaccination Assay

To prepare the whole-cell vaccine, CT26 cells were treated with either: 1) 300 mJ of plasma, 2) Cisplatin (50 μM) or 3) complete media. Plasma-created vaccine was prepared from cells treated in 24-plates with plasma and cultured in regular media for 24 hours. Cisplatin-vaccine was prepared from cells incubated for 24 hours in Cisplatin media. Media-Vaccine was prepared from cells cultured in regular, complete media for 24 hours. Cisplatin- and media-vaccines were used as controls.

After a 24-hour incubation 3×106 cells in 100 μL of PBS were inoculated subcutaneously into the left flank of Balb/c mice. Seven days later, mice were challenged with 3×105 live CT26 cells subcutaneously injected into the right flank. Tumors were measured twice weekly with calipers and all mice were euthanized on day 28.

H&E Staining of Tissue Sections and Damage Assessment

Tumors, with overlaying skin, were resected 1 or 3 days after the final plasma treatment and fixed in 10% formalin for at least 48 hours. Tissue was then paraffin-embedded, sectioned with a microtome, deparaffinized and stained with hematoxylin and eosin. Images of stained sections were captured using the EVOS FL Auto Cell imaging system. Sections were evaluated for damaged by a blinded pathologist.

Immunofluorescence Staining of Tumor Tissue

Tumor sections from day 3 after final plasma treatment were used for fluorescence detection of DAMP signals and immune cell recruitment. For antigen retrieval, slides were transferred to a Dako Target Retrieval buffer pH9 (1:10 dilution in H2O) and boiled for 15 min in a pressure cooker.

Slides were then cooled and blocked with blocking solution (10% milk in PBS+0.3% v/v TritonX+15 μL Fab donkey anti-mouse IgG (H+L) fragments) for 1 hour at room temperature in a humidified chamber. Following blocking, tumor sections were stained the following antibodies (1:100 in blocking solution) overnight at 4° C. in a humidified environment: anti-mouse CRT (PA3-900, ThermoFisher Scientific, USA) and anti-mouse HMGB1 (MA5-16,264, ThermoFisher Scientific, USA) or anti-mouse CD45 (103,101, Biolegend, USA) and anti-mouse CD11c (33,483, Abcam, USA). Tissue samples were then washed four times with PBS+0.1% v/v Tween (PBST). Secondary antibodies (1:1000 in blocking bluffer) were added: donkey anti-rabbit IgG Alexa Fluor 594 for CRT (A21207, Life Technologies, USA), goat anti-mouse IgG Alexa Fluor 488 for HMGB1 (115-545-205, Jackson Immuno, USA), donkey anti-rat IgG (H+L) Alexa Fluor 594 for CD45 (A21209, Life Technologies, USA) and goat anti-armenian hamster IgG (H+L) Alexa Fluor 488 for CD11c (127-545-160, Jackson Immuno, USA). Tissue sections were stained for 1.5 hours at room temperature in a humidified environment, protected from light. Following secondary staining, tissue sections were washed four times with PBST and mounted with DAPI (P36935, Molecular Probes, USA). A glass cover slip was placed on top of each tissue section and cured overnight. Sections were viewed under an EVOS FL Auto Imaging System (Life Technologies, USA). Using ImageJ software, mean fluorescence intensity of DAMPs and CD45+/CD11c+ signals were determined by measuring the intensity of three representative areas on the tissue. Data are presented as normalized mean fluorescence intensity of individual resected tumors.

ELISpot Analysis

IFNγ ELISpot assays were previously described. [134] Briefly, on Day 1, multiscreen filtration plates (Millipore, MSIPS4W10) plates were coated with 100 uL per well of anti-IFNγ antibody (BD Biosciences, USA; clone R4-6A2; 10 ug/mL) overnight at 4° C. On day 2, the coating antibody was discarded, the plate washed and blocked. Splenocyes were isolated via mechanical disruption with RBC lysis and added at 1×106 cells per well in cRPMI. The following stimulators were added: DMSO (negative control), 10 μg/mL GUCY2C254-262 peptide (JPT, Germany) or 10 μg/mL AH-1 peptide (AnaSpec, USA) for 24 hours in cRPMI. Plates were incubated at 37° C., 5% CO2 for 24 hours and spots were developed with 2 μg/mL biotinylated anti-IFNγ detection antibody (BD Biosciences, USA; clone XMG1.2) and 2 μg/mL alkaline phosphatase-conjugated streptavidin (ThermoFisher Scientific, USA), followed by NBT/BCIP substrate (ThermoFisher Scientific, USA). Spot forming cells were enumerated using the S6 Universal-V Analyzer automated reader system, software ImmunoSpot v5 (Cellular Technology Limited, USA). Spot parameters were established using automated gating and quantification. Data are presented as antigen-specific spots (normalized by subtracting the DMSO baseline negative control values).

REFERENCES

The following references may be useful in understanding some of the principles discussed herein:

1. M. Laroussi, X. Lu, and M. Keidar Perspective: The physics, diagnostics, and applications of atmospheric pressure low temperature plasma sources used in plasma medic ine Journal of Applied Physics 122, 020901 (2017);
2. Winter J, Brandenburg R and Weltmann K-D 2015 Atmospheric pressure plasma jets: an overview of devices and new directions Plasma Sources Sci. Technol. 24 64001
3. X Lu et al 2012 Plasma Sources Sci. Technol. 21 034005
4. S E Babayan et al 1998 Plasma Sources Sci. Technol. 7 286
5. Fiorenza Fanelli and Francesco Fracassia, Atmospheric pressure non-equilibrium plasma jet technology: general features, specificities and applications in surface processing of materials, Surface and Coatings Technology, 322, pp 174-201, 2017
6. J Ehlbeck et al 2011 J. Phys. D: Appl. Phys. 44 013002
7. Laroussi, M., Tendero, C., Lu, X., Alla, S. and Hynes, W. L. (2006), Inactivation of Bacteria by the Plasma Pencil. Plasma Processes Polym., 3: 470-473
8. Mounir Laroussi, Low-Temperature Plasma Jet for Biomedical Applications: A Review, IEEE Transactions on Plasma Science, 2015, 43, 3, 703
9. M. Laroussi, E. Karakas and W. Hynes "Influence of cell type, initial concentration, and medium on the inactivation efficiency of low-temperature plasma" IEEE Trans. Plasma Sci., vol. 39, no. 11, pp. 2960-2961, 2011
10. N. Barekzi and M. Laroussi "Effects of low temperature plasmas on cancer cells" Plasma Process. Polym., vol. 10, no. 12, pp. 1039-1050, 2013
11. M. Keidar "Cold atmospheric plasma in cancer therapy" Phys. Plasmas, vol. 20, no. 5, p. 057101, 2013
12. M. Vandamme E. Robert J. Sobilo V. Sarron D. Ries S. Dozias B. Legrain S. Lerondel A. L. Pape J. M. Pouvesle "In situ application of non-thermal plasma: Preliminary investigations for colorectal and lung tolerance" Proc. 20th Int. Symp. Plasma Chem. pp. 1-4 2011.
13. Ghasemi M, Olszewski P, Bradley J W and Walsh J L 2013 Interaction of multiple plasma plumes in an atmospheric pressure plasma jet array J. Phys. D: Appl. Phys. 46 52001
14. Q Y Nie et al 2009 New J. Phys. 11 115015
15. Natalia Yu Babaeva and Mark J Kushner 2014 Plasma Sources Sci. Technol. 23 015007
16. Cao Z, Walsh J L and Kong M G 2009 Appl. Phys. Lett. 94 021501
17. Foest R, Kindel E, Ohl A, Stieber M and Weltmann K D 2005 Plasma Phys. Control. Fusion 47 B525
18. Ma J H, Shih D C, Park S-J and Eden J G 2011 IEEE Trans. Plasma Sci. 39 2700
19. E. Robert et al New insights on the propagation of pulsed atmospheric plasma streams: From single jet to multi jet arrays 2015 Physics of Plasmas 22 122007
20. Asma Begum, Mounir Laroussi, and Mohammad Rasel Pervez, Atmospheric pressure He-air plasma jet: Breakdown process and propagation phenomenon, AIP Advances 3, 062117 (2013)
21. X. Lu, G.V. Naidis, M. Laroussi and K. Ostrikov Guided ionization waves: Theory and experiments Physics Reports 540 (2014) 123-166
22. M. Teschke, J. Kedzierski, E. G. Finantu-Dinu, D. Korzec, and J. Engemann, High-Speed Photographs of a Dielectric Barrier Atmospheric Pressure Plasma Jet IEEE TRANSACTIONS ON PLASMA SCIENCE, VOL. 33, NO. 2, APRIL 2005
23. Murakami T, Niemi K, Gans T, O'Connell D and Graham W G 2013 Chemical kinetics and reactive species in atmospheric pressure helium-oxygen plasmas with humid-air impurities Plasma Sources Sci. Technol. 22 15003

24. Damy T, Pouvesle J-M, Puech V, Douat C, Dozias S and Robert E 2017 Analysis of conductive target influence in plasma jet experiments through helium metastable and electric field measurements Plasma Sources Sci. Technol. 26 45008
25. Boselli M, Colombo V, Ghedini E, Gherardi M, Laurita R, Liguori A, Sanibondi P and Stancampiano A 2014 Schlieren high-speed imaging of a nanosecond pulsed atmospheric pressure non-equilibrium plasma jet Plasma Chem. Plasma Process. 34 853-69
26. Robert E, Sarron V, Ries D, Dozias S, Vandamme M and Pouvesle J-M 2012 Characterization of pulsed atmospheric pressure plasma streams (PAPS) generated by a plasma gun Plasma Sources Sci. Technol. 21 34017
27. Bourdon A, Damy T, Pechereau F, Pouvesle J-M, Viegas P, Iséni S and Robert E 2016 Numerical and experimental study of the dynamics of a us helium plasma gun discharge with various amounts of N2 admixture Plasma Sources Sci. Technol. 25 35002
28. T Damy et al 2017 Plasma Sources Sci. Technol. 26 105001
29. J-P Boeuf, L L Yang and L C Pitchford Dynamics of a guided streamer ('plasma bullet') in a helium jet in air at atmospheric pressure J. Phys. D: Appl. Phys. 46 (2013) 015201 (13pp)
30. Julien Jarrige et al 2010 Plasma Sources Sci. Technol. 19 065005
31. Dayonna Park, Gregory Fridman, Alexander Fridman, Danil Dobrynin, Plasma Bullets Propagation Inside of Agarose Tissue Model, IEEE Transactions on Plasma Science, 2013, 41, 7, 1725
32. Chong Liu et al 2014 J. Phys. D: Appl. Phys. 47 252003
33. X Lu et al 2012 Plasma Sources Sci. Technol. 21 034005
34. N Mericam-Bourdet et al 2009 J. Phys. D: Appl. Phys. 42 055207
35. Yan D, Sherman J H, Keidar M. Cold atmospheric plasma, a novel promising anti-cancer treatment modality. Oncotarget. 2016; 8(9):15977-15995.
36. Miller, V., Lin, A. & Fridman, A. Plasma Chem Plasma Process (2016) 36: 259.
37. Bekeschus S., Pouvesle J M., Fridman A., Miller V. (2018) Cancer Immunology. In: Metelmann H R., von Woedtke T., Weltmann K D. (eds) Comprehensive Clinical Plasma Medicine. Springer, Cham
38. Group EBCTC. Effect of radiotherapy after breast-conserving surgery on 10-year recurrence and 15-year breast cancer death: meta-analysis of individual patient data for 10 801 women in 17 randomised trials. The Lancet. 2011; 378(9804):1707-1716.
39. Goldberg R M, Sargent D J, Morton R F, Fuchs C S, Ramanathan R K, Williamson S K, Findlay B P, Pitot H C, Alberts S R. A randomized controlled trial of fluorouracil plus leucovorin, irinotecan, and oxaliplatin combinations in patients with previously untreated metastatic colorectal cancer. Journal of Clinical Oncology. 2004; 22(1):23-30.
40. Yang A D, Fan F, Camp E R, van Buren G, Liu W, Somcio R, Gray M J, Cheng H, Hoff P M, Ellis L M. Chronic oxaliplatin resistance induces epithelial-to-mesenchymal transition in colorectal cancer cell lines. Clin Cancer Res. 2006; 12(14):4147-4153.
41. Casares N, Pequignot M O, Tesniere A, Ghiringhelli F, Roux S, Chaput N, Schmitt E, Hamai A, Hervas-Stubbs S, Obeid M. Caspase-dependent immunogenicity of doxorubicin-induced tumor cell death. J Exp Med. 2005; 202(12):1691-1701.
42. Obeid M, Panaretakis T, Tesniere A, Joza N, Tufi R, Apetoh L, Ghiringhelli F, Zitvogel L, Kroemer G. Leveraging the immune system during chemotherapy: moving calreticulin to the cell surface converts apoptotic death from "silent" to immunogenic. Cancer Research. 2007; 67(17):7941-7944.
43. Green D R, Ferguson T, Zitvogel L, Kroemer G. Immunogenic and tolerogenic cell death. Nature Reviews Immunology. 2009; 9 (5):353-363.
44. Dobrynin D, Fridman G, Friedman G, Fridman A. Physical and biological mechanisms of direct plasma interaction with living tissue. New Journal of Physics. 2009; 11(11):115020.
45. Lin A, Chernets N, Han J, Alicea Y, Dobrynin D, Fridman G, Freeman T A, Fridman A, Miller V. Non-Equilibrium Dielectric Barrier Discharge Treatment of Mesenchymal Stem Cells: Charges and Reactive Oxygen Species Play the Major Role in Cell Death. Plasma Process Polym. 2015; 12(10):1117-1127.
46. Bruggeman P, Leys C. Non-thermal plasmas in and in contact with liquids. J Phys D: Appl Phys. 2009; 42(5): 053001.
47. Babaeva N Y, Kushner M J. Intracellular electric fields produced by dielectric barrier discharge treatment of skin. J Phys D: Appl Phys. 2010; 43(18):185206.
48. Babaeva N Y, Kushner M J. Reactive fluxes delivered by dielectric barrier discharge filaments to slightly wounded skin. J Phys D: Appl Phys. 2013; 46(2):025401.
49. Ayan H, Staack D, Fridman G, Gutsol A, Mukhin Y, Starikovskii A, Fridman A, Friedman G. Application of nanosecond-pulsed dielectric barrier discharge for biomedical treatment of topographically non-uniform surfaces. J Phys D: Appl Phys. 2009; 42 (12): 125202.
50. Isbary G, Morfill G, Schmidt H, Georgi M, Ramrath K, Heinlin J, Karrer S, Landthaler M, Shimizu T, Steffes B. A first prospective randomized controlled trial to decrease bacterial load using cold atmospheric argon plasma on chronic wounds in patients. British Journal of Dermatology. 2010; 163(1):78-82.
51. Brune L, Vandamme M, Riès D, Martel E, Robert E, Lerondel S, Trichet V, Richard S, Pouvesle J-M, Le Pape A. Effects of a non thermal plasma treatment alone or in combination with gemcitabine in a MIA PaCa2-luc orthotopic pancreatic carcinoma model. PloS one. 2012; 7(12): e52653.
52. Walk R M, Snyder J A, Srinivasan P, Kirsch J, Diaz S O, Blanco F C, Shashurin A, Keidar M, Sandler A D. Cold atmospheric plasma for the ablative treatment of neuroblastoma. Journal of pediatric surgery. 2013; 48(1):67-73.
53. Chernets N, Kurpad D S, Alexeev V, Rodrigues D B, Freeman T A. Reaction Chemistry Generated by Nanosecond Pulsed Dielectric Barrier Discharge Treatment is Responsible for the Tumor Eradication in the B16 Melanoma Mouse Model. Plasma Process Polym. 2015; 12(12):1400-1409.
54. Keidar M, Walk R, Shashurin A, Srinivasan P, Sandler A, Dasgupta S, Ravi R, Guerrero-Preston R, Trink B. Cold plasma selectivity and the possibility of a paradigm shift in cancer therapy. Br J Cancer. 2011; 105(9):1295-1301.
55. Hirst A M, Frame F M, Arya M, Maitland N J, O'Connell D. Low temperature plasmas as emerging cancer therapeutics: the state of play and thoughts for the future. Tumor Biology. 2016; 37 (6):7021-7031.
56. Bekeschus S, Mueller A, Gaipl U, Weltmann K-D. Physical plasma elicits immunogenic cancer cell death and mitochondrial singlet oxygen. IEEE Transactions on Radiation and Plasma Medical Sciences. 2018; 2(2):138-146.

57. Bekeschus S, Rodder K, Fregin B, Otto O, Lippert M, Weltmann K-D, Wende K, Schmidt A, Gandhirajan R K. Toxicity and Immunogenicity in Murine Melanoma following Exposure to Physical Plasma-Derived Oxidants. Oxidative medicine and cellular longevity. 2017; 201712.
58. Lin A, Truong B, Pappas A, Kirifides L, Oubarri A, Chen S, Lin S, Dobrynin D, Fridman G, Fridman A. Uniform Nanosecond Pulsed Dielectric Barrier Discharge Plasma Enhances Anti-Tumor Effects by Induction of Immunogenic Cell Death in Tumors and Stimulation of Macrophages. Plasma Process Polym. 2015; 12(12):1392-1399.
59. Lin A, Truong B, Patel S, Kaushik N, Choi E H, Fridman G, Fridman A, Miller V. Nanosecond-Pulsed DBD Plasma-Generated Reactive Oxygen Species Trigger Immunogenic Cell Death in A549 Lung Carcinoma Cells through Intracellular Oxidative Stress. International Journal of Molecular Sciences. 2017; 18(5):966.
60. Kepp O, Senovilla L, Vitale I, Vacchelli E, Adjemian S, Agostinis P, Apetoh L, Aranda F, Barnaba V, Bloy N. Consensus guidelines for the detection of immunogenic cell death. Oncoimmunology. 2014; 3(9): e955691.
61. Obeid M, Tesniere A, Ghiringhelli F, Fimia G M, Apetoh L, Perfettini J-L, Castedo M, Mignot G, Panaretakis T, Casares N. Calreticulin exposure dictates the immunogenicity of cancer cell death. Nature medicine. 2007; 13(1): 54-61.
62. Gardai S J, McPhillips K A, Frasch S C, Janssen W J, Starefeldt A, Murphy-Ullrich J E, Bratton D L, Oldenborg P-A, Michalak M, Henson P M. Cell-surface calreticulin initiates clearance of viable or apoptotic cells through trans-activation of LRP on the phagocyte. Cell. 2005; 123(2):321-334. 26.
63. Panaretakis T, Kepp O, Brockmeier U, Tesniere A, Bjorklund A C, Chapman D C, Durchschlag M, Joza N, Pierron G, van Endert P. Mechanisms of pre-apoptotic calreticulin exposure in immunogenic cell death. The EMBO journal. 2009; 28(5):578-590.
64. Chao M P, Jaiswal S, Weissman-Tsukamoto R, Alizadeh A A, Gentles A J, Volkmer J, Weiskopf K, Willingham S B, Raveh T, Park C Y. Calreticulin is the dominant pro-phagocytic signal on multiple human cancers and is counterbalanced by CD47. Science Translational Medicine. 2010; 2(63):63ra94-63ra94.
65. Fernandez N C, Lozier A, Flament C, Ricciardi-Castagnoli P, Bellet D, Suter M, Perricaudet M, Tursz T, Maraskovsky E, Zitvogel L. Dendritic cells directly trigger NK cell functions: cross-talk relevant in innate anti-tumor immune responses in vivo. Nature medicine. 1999; 5(4):405-411.
66. Guermonprez P, Valladeau J, Zitvogel L, Théry C, Amigorena S. Antigen presentation and T cell stimulation by dendritic cells. Annual review of immunology. 2002; 20(1):621-667.
67. Klebanoff C A, Gattinoni L, Torabi-Parizi P, Kerstann K, Cardones A R, Finkelstein S E, Palmer D C, Antony P A, Hwang S T, Rosenberg S A. Central memory self/tumor-reactive CD8+ T cells confer superior antitumor immunity compared with effector memory T cells. Proceedings of the National Academy of Sciences of the United States of America. 2005; 102(27):9571-9576. 31.
68. Kroemer G, Galluzzi L, Kepp O, Zitvogel L. Immunogenic cell death in cancer therapy. Annual review of immunology. 2013; 3151-72.
69. Garg A D, Krysko D V, Verfaillie T, Kaczmarek A, Ferreira G B, Marysael T, Rubio N, Firczuk M, Mathieu C, Roebroek A J. A novel pathway combining calreticulin exposure and ATP secretion in immunogenic cancer cell death. The EMBO journal. 2012; 31(5):1062-1079.
70. Martins I, Wang Y, Michaud M, Ma Y, Sukkurwala A, Shen S, Kepp O, Métivier D, Galluzzi L, Perfettini J. Molecular mechanisms of ATP secretion during immunogenic cell death. Cell Death & Differentiation. 2014; 21(1):79-91.
71. La Sala A, Ferrari D, Di Virgilio F, Idzko M, Norgauer J, Girolomoni G. Alerting and tuning the immune response by extracellular nucleotides. Journal of leukocyte biology. 2003; 73 (3):339-343.
72. Bianchi M E, Manfredi A A. High-mobility group box 1 (HMGB1) protein at the crossroads between innate and adaptive immunity. Immunological reviews. 2007; 220 (1):35-46.
73. Orlova V V, Choi E Y, Xie C, Chavakis E, Bierhaus A, Ihanus E, Ballantyne C M, Gahmberg C G, Bianchi M E, Nawroth P P. A novel pathway of HMGB1-mediated inflammatory cell recruitment that requires Mac-1-integrin. The EMBO journal. 2007; 26(4):1129-1139.
74. Tesniere A, Schlemmer F, Boige V, Kepp O, Martins I, Ghiringhelli F, Aymeric L, Michaud M, Apetoh L, Barault L. Immunogenic death of colon cancer cells treated with oxaliplatin. Oncogene. 2010; 29(4):482-491.
75. Bell C W, Jiang W, Reich C F, Pisetsky D S. The extracellular release of HMGB1 during apoptotic cell death. Am J Physiol, Cell Physiol. 2006; 291(6):C1318-C1325.
76. Fucikova J, Moserova I, Truxova I, Hermanova I, Vancurova I, Partlova S, Fialova A, Sojka L, Cartron P F, Houska M. High hydrostatic pressure induces immunogenic cell death in human tumor cells. Int J Cancer. 2014; 135(5):1165-1177.
77. Altin J G, Sloan E K. The role of CD45 and CD45-associated molecules in T cell activation. Immunol Cell Biol. 1997; 75(5): 430-445.
78. Ledbetter J A, Tonks N K, Fischer E H, Clark E A. CD45 regulates signal transduction and lymphocyte activation by specific association with receptor molecules on T or B cells. Proceedings of the National Academy of Sciences. 1988; 85(22):8628-8632.
79. Snook A E, Magee M S, Waldman S A. GUCY2C-targeted cancer immunotherapy: past, present and future. Immunol Res. 2011; 51 (2-3):161-169. doi:10.1007/s12026-011-8253-7
80. Snook A E, Eisenlohr L C, Rothstein J L, Waldman S A. Cancer mucosa antigens as a novel immunotherapeutic class of tumor associated antigen. Clin Pharmacol Ther. 2007; 82(6):734-739. doi:10.1038/sj.clpt.6100369
81. Xiang B, Baybutt T R, Berman-Booty L, Magee M S, Waldman S A, Alexeev V Y, Snook A E. Prime-Boost Immunization Eliminates Metastatic Colorectal Cancer by Producing High-Avidity Effector CD8$^{+}$ T Cells. J Immunol. 2017; 198(9):3507-3514. doi:10.4049/jimmunol.1502672
82. Snook A E, Baybutt T R, Hyslop T, Waldman S A. Preclinical Evaluation of a Replication-Deficient Recombinant Adenovirus Serotype 5 Vaccine Expressing Guanylate Cyclase C and the PADRE T-helper Epitope. Hum Gene Ther Methods. 2016; 27 (6):238-250. doi:10.1089/hgtb.2016.114
83. Snook A E, Magee M S, Schulz S, Waldman S A. Selective antigen specific CD4(+) T-cell, but not CD8(+)

T- or B-cell, tolerance corrupts cancer immunotherapy. Eur J Immunol. 2014; 44 (7):1956-1966. doi:10.1002/eji.201444539

84. Snook A E, Magee M S, Marszalowicz G P, Schulz S, Waldman S A. Epitope-targeted cytotoxic T cells mediate lineage-specific antitumor efficacy induced by the cancer mucosa antigen GUCY2C. Cancer Immunol Immunother. 2012; 61(5):713-723. doi:10.1007/s00262-011-1133-0

85. Snook A E, Li P, Stafford B J, Faul E J, Huang L, Birbe R C, Bombonati A, Schulz S, Schnell M J, Eisenlohr L C, et al. Lineage specific T-cell responses to cancer mucosa antigen oppose systemic metastases without mucosal inflammatory disease. Cancer Res. 2009; 69(8):3537-3544. doi:10.1158/0008-5472.CAN-08-3386

86. Snook A E, Stafford B J, Li P, Tan G, Huang L, Birbe R, Schulz S, Schnell M J, Thakur M, Rothstein J L, et al. Guanylyl cyclase C induced immunotherapeutic responses opposing tumor metastases without autoimmunity. J Natl Cancer Inst. 2008; 100 (13):950-961. doi:10.1093/jnci/djn178

87. Snook A E, Huang L, Schulz S, Eisenlohr L C, Waldman S A. Cytokine adjuvanation of therapeutic anti-tumor immunity targeted to cancer mucosa antigens. Clin Transl Sci. 2008; 1(3):263-264. doi:10.1111/j.1752-8062.2008.00054.x 88. Witek M, Blomain E S, Magee M S, Xiang B, Waldman S A, Snook A E. Tumor radiation therapy creates therapeutic vaccine responses to the colorectal cancer antigen GUCY2C. Int J Radiat Oncol Biol Phys. 2014; 88(5):1188-1195. doi:10.1016/j.ijrobp.2013.12.043

89. Snook A, Baybutt T, Mastrangelo M, Lewis N, Goldstein S, Kraft W, Oppong Y, Hyslop T, Myers R, Alexeev V, et al. A Phase I study of Ad5-GUCY2C-PADRE in stage I and II colon cancer patients. Journal for ImmunoTherapy of Cancer. 2015; 3(Suppl 2): P450.doi:10.1186/2051-1426-3-s2-p450

90. Ribas A, Timmerman J M, Butterfield L H, Economou J S. Determinant spreading and tumor responses after peptide-based cancer immunotherapy. Trends in immunology. 2003; 24(2):58-61.

91. Van der Most R G, Currie A, Robinson B W, Lake R A. Cranking the immunologic engine with chemotherapy: using context to drive tumor antigen cross-presentation towards useful antitumor immunity. Cancer Research. 2006; 66(2):601-604.

92. Facciponte J G, Ugel S, De Sanctis F, Li C, Wang L, Nair G, Sehgal S, Raj A, Matthaiou E, Coukos G. Tumor endothelial marker 1-specific DNA vaccination targets tumor vasculature. The Journal of clinical investigation. 2014; 124(4):1497-1511.

93. Huang A Y, Gulden P H, Woods A S, Thomas M C, Tong C D, Wang W, Engelhard V H, Pasternack G, Cotter R, Hunt D. The immunodominant major histocompatibility complex class Irestricted antigen of a murine colon tumor derives from an endogenous retroviral gene product. Proceedings of the National Academy of Sciences. 1996; 93(18):9730-9735.

94. Rice J, Buchan S, Stevenson F K. Critical components of a DNA fusion vaccine able to induce protective cytotoxic T cells against a single epitope of a tumor antigen. The Journal of Immunology. 2002; 169(7):3908-3913.

95. Yu Z, Geng J, Zhang M, Zhou Y, Fan Q, Chen J. Treatment of osteosarcoma with microwave thermal ablation to induce immunogenic cell death. Oncotarget. 2014; 5(15):6526.

96. Zitvogel L, Apetoh L, Ghiringhelli F, Kroemer G. Immunological aspects of cancer chemotherapy. Nature Reviews Immunology. 2008; 8(1):59-73.

97. Palumbo M O, Kavan P, Miller Jr W H, Panasci L, Assouline S, Johnson N, Cohen V, Patenaude F, Pollak M, Jagoe R T. Systemic cancer therapy: achievements and challenges that lie ahead. Frontiers in pharmacology. 2013; 4(57):1-9.

98. Bentzen S M. Preventing or reducing late side effects of radiation therapy: radiobiology meets molecular pathology. Nature reviews Cancer. 2006; 6(9):702-713. doi:10.1038/nrc1950

99. Burstein H J. Side effects of chemotherapy. Journal of Clinical Oncology. 2000; 18(3):693-693.

100. Mellman I, Coukos G, Dranoff G. Cancer immunotherapy comes of age. Nature. 2011; 480(7378):480-489.

101. Naidoo J, Wang X, Woo K M, Iyriboz T, Halpenny D, Cunningham J, Chaft J E, Segal N H, Callahan M K, Lesokhin A M. Pneumonitis in Patients Treated With Anti-Programmed Death-1/Programmed Death Ligand 1 Therapy. Journal of Clinical Oncology. 2016JCO682005.

102. Beck K E, Blansfield J A, Tran K Q, Feldman A L, Hughes M S, Royal R E, Kammula U S, Topalian S L, Sherry R M, Kleiner D. Enterocolitis in patients with cancer after antibody blockade of cytotoxic T-lymphocyte-associated antigen 4. Journal of Clinical Oncology. 2006; 24(15):2283-2289.

103. Krysko O, Aaes T L, Bachert C, Vandenabeele P, Krysko D. Many faces of DAMPs in cancer therapy. Cell death & disease. 2013; 4 (5):e631.

104. Gameiro S R, Jammeh M L, Wattenberg M M, Tsang K Y, Ferrone S, Hodge J W. Radiation-induced immunogenic modulation of tumor enhances antigen processing and calreticulin exposure, resulting in enhanced T-cell killing. Oncotarget. 2014; 5(2):403-416.

105. Galluzzi L, Buqué A, Kepp O, Zitvogel L, Kroemer G. Immunogenic cell death in cancer and infectious disease. Nature Reviews Immunology. 2016; 12(2):97.

106. Galluzzi L, Vitale I, Aaronson S A, Abrams J M, Adam D, Agostinis P, Alnemri E S, Altucci L, Amelio I, Andrews D W. Molecular mechanisms of cell death: Recommendations of the Nomenclature Committee on Cell Death 2018. Cell Death & Differentiation. 2018; 25486-541.

107. Obeid M, Panaretakis T, Joza N, Tufi R, Tesniere A, Van Endert P, Zitvogel L, Kroemer G. Calreticulin exposure is required for the immunogenicity of γ-irradiation and UVC light-induced apoptosis. Cell Death & Differentiation. 2007; 14(10):1848-1850.

108. Michaud M, Martins I, Sukkurwala A Q, Adjemian S, Ma Y, Pellegatti P, Shen S, Kepp O, Scoazec M, Mignot G. Autophagy dependent anticancer immune responses induced by chemotherapeutic agents in mice. Science. 2011; 334(6062):1573-1577.

109. Apetoh L, Ghiringhelli F, Tesniere A, Obeid M, Ortiz C, Criollo A, Mignot G, Maiuri M C, Ullrich E, Saulnier P. Toll-like receptor 4-dependent contribution of the immune system to anticancer chemotherapy and radiotherapy. Nature medicine. 2007; 13(9):1050.

110. Sistigu A, Yamazaki T, Vacchelli E, Chaba K, Enot D P, Adam J, Vitale I, Goubar A, Baracco E E, Remedios C. Cancer cell-autonomous contribution of type I interferon signaling to the efficacy of chemotherapy. Nature medicine. 2014; 20(11):1301.

111. Chiba S, Baghdadi M, Akiba H, Yoshiyama H, Kinoshita I, Dosaka-Akita H, Fujioka Y, Ohba Y, Gorman J V, Colgan J D. Tumor-infiltrating DCs suppress nucleic acid-mediated innate immune responses through interactions between the receptor TIM-3 and the alarmin HMGB1. Nature immunology. 2012; 13(9):832.

112. Peschiaroli F, Businaro L, Gerardino A, Ladoire S, Apetoh L, Bravo-San J M. Chemotherapy-induced antitumor immunity requires formyl peptide receptor. 360 (6394):aad0779. doi:10.1126/science.aad0779

113. GARG A, Krysko D, Vandenabeele P, Agostinis P. Extracellular ATP and P2X7 receptor exert context-specific immunogenic effects after immunogenic cancer cell death. Cell death & disease. 2016; 7(e2097):3.

114. Ranieri P, Shrivastav R, Wang M, Lin A, Gregory Fridman, Fridmam A, Han L, Miller V. Nanosecond pulsed Dielectric Barrier Discharge induced Anti-Tumor Effects Propagate Through the depth of Tissue via Intracellular Signaling. Plasma Medicine. 2017; 7(3):283-297. doi:10.1615/PlasmaMed.2017019883

115. Miller V, Lin A, Fridman G, Dobrynin D, Fridman A. Plasma Stimulation of Migration of Macrophages. Plasma Process Polym. 2014; 11(12):1193-1197.

116. Bekeschus S, Schmidt A, Bethge L, Masur K, von Woedtke T, Hasse S, Wende K. Redox stimulation of human thp-1 monocytes in response to cold physical plasma. Oxidative medicine and cellular longevity. 2015; 20165910695.

117. Kaushik N K, Kaushik N, Min B, Choi K H, Hong Y J, Miller V, Fridman A, Choi E H. Cytotoxic macrophage-released tumour necrosis factor-alpha (TNF-α) as a killing mechanism for cancer cell death after cold plasma activation. J Phys D: Appl Phys. 2016; 49(8):084001.

118. Bekeschus S, Moritz J, Schmidt A, Wende K. Redox regulation of leukocyte-derived microparticle release and protein content in response to cold physical plasma-derived oxidants. Clinical Plasma Medicine. 2017; 7(8): 24-35.

119. Kawase Y, Naito S, Ito M, Sekine I, Fujii H. The Effect of Ionizing Radiation on Epidermal Langerhans Cells—A Quantitative Analysis of Autopsy Cases with Radiation Therapy—. J Radiat Res. 1990; 31(3):246-255.

120. Liao Y-P, Wang C-C, Butterfield L H, Economou J S, Ribas A, Meng W S, Iwamoto K S, McBride W H. Ionizing radiation affects human MART-1 melanoma antigen processing and presentation by dendritic cells. The Journal of Immunology. 2004; 173 (4):2462-2469.

121. Gollnick S O, Liu X, Owczarczak B, Musser D A, Henderson B W. Altered expression of interleukin 6 and interleukin 10 as a result of photodynamic therapy in vivo. Cancer research. 1997; 57 (18):3904-3909.

122. Lee A, Lin A, Shah K, Singh H, Miller V, Rao S G. Optimization of Non-Thermal Plasma Treatment in an In Vivo Model Organism. PloS one. 2016; 11(8):e0160676.

123. Mohades S, Laroussi M, Sears J, Barekzi N, Razavi H. Evaluation of the effects of a plasma activated medium on cancer cells. Physics of Plasmas. 2015; 22(12):122001.

124. Traylor M J, Pavlovich M J, Karim S, Hait P, Sakiyama Y, Clark D S, Graves D B. Long-term antibacterial efficacy of air plasma-activated water. J Phys D: Appl Phys. 2011; 44(47):472001.

125. Yan D, Talbot A, Nourmohammadi N, Cheng X, Canady J, Sherman J, Keidar M. Principles of using cold atmospheric plasma stimulated media for cancer treatment. Scientific reports. 2015; 518339. doi:10.1038/srep18339

126. Utsumi F, Kajiyama H, Nakamura K, Tanaka H, Mizuno M, Ishikawa K, Kondo H, Kano H, Hori M, Kikkawa F. Effect of indirect nonequilibrium atmospheric pressure plasma on antiproliferative activity against chronic chemo-resistant ovarian cancer cells in vitro and in vivo. PloS one. 2013; 8(12):e81576.

127. Judée F, Fongia C, Ducommun B, Yousfi M, Lobjois V, Merbahi N. Short and long time effects of low temperature Plasma Activated Media on 3D multicellular tumor spheroids. Scientific reports. 2016; 621421

128. Polak M, Winter J, Schnabel U, Ehlbeck J, Weltmann K D. Innovative Plasma Generation in Flexible Biopsy Channels for Inner-Tube Decontamination and Medical Applications. Plasma Process Polym. 2012; 9(1):67-76.

129. Kim J Y, Ballato J, Foy P, Hawkins T, Wei Y, Li J, Kim S-O. Apoptosis of lung carcinoma cells induced by a flexible optical fiber-based cold microplasma. Biosensors Bioelectron. 2011; 28 (1):333-338.

130. Robert E, Vandamme M, Brullé L, Lerondel S, Le Pape A, Sarron V, Riès D, Darny T, Dozias S, Collet G. Perspectives of endoscopic plasma applications. Clinical Plasma Medicine. 2013; 1(2):8-16.

131. Vanneman M, Dranoff G. Combining immunotherapy and targeted therapies in cancer treatment. Nature Reviews Cancer. 2012; 12(4):237-251.

132. Miller V, Lin A, Fridman A. Why Target Immune Cells for Plasma Treatment of Cancer. Plasma Chem Plasma Process. 2015; 36(1): 259-268.

133. Kepp O, Galluzzi L, Martins I, Schlemmer F, Adjemian S, Michaud M, Sukkurwala A Q, Menger L, Zitvogel L, Kroemer G. Molecular determinants of immunogenic cell death elicited by anticancer chemotherapy. Cancer and Metastasis Reviews. 2011; 30(1):61-69.

134. Snook A E, Stafford B J, Li P, Tan G, Huang L, Birbe R, Schulz S, Schnell M J, Thakur M, Rothstein J L. Guanylyl Cyclase C—Induced Immunotherapeutic Responses Opposing Tumor Metastases Without Autoimmunity. Journal of the National Cancer Institute. 2008; 100(13):950-961.

135. Abraham G. Lin, Bo Xiang, Dante J. Merlino, Trevor R. Baybutt, Joya Sahu, Alexander Fridman, Adam E. Snook & Vandana Miller (2018) Non-thermal plasma induces immunogenic cell death in vivo in murine CT26 colorectal tumors, Oncolmmunology, 7:9, e1484978, DOI: 10.1080/2162402X.2018.1484978

What is claimed is:

1. A plasma generator for forming a plasma jet comprising;

a dielectric body comprising four sides and two ends defining a cavity located within the dielectric body, said cavity having a length extending from a first end of said body to a second end of said body, a height extending from a first side of said body to a second side of said body, the second side located opposite the first side, and a width measured orthogonal to the length and height, and the width of the cavity is greater than the height of the cavity;

at least one aperture in the second end of the dielectric body;

a high voltage electrode located proximate to said first side of the dielectric body and having a surface facing toward the cavity;

a grounded electrode located proximate to said second side of the dielectric body and having a surface facing toward the surface of the high voltage electrode, and a distance between the surface of the grounded electrode and the surface of the high voltage having a variability of no greater than 10%;

at least one gas inlet formed proximate to the first end of the dielectric body; and a power supply connected to said high voltage electrode, wherein the power supply is configured to provide an alternating energy to said high voltage electrode.

2. The plasma generator of claim 1, wherein a distance between the high voltage electrode and the grounded electrode measured through air outside of the dielectric body is greater than a distance that would permit an electrical connection between the high voltage electrode and the grounded electrode when the plasma generator is in operation.

3. The plasma generator of claim 1, wherein a volume and velocity of a gas entering the at least one gas inlet is sufficient to prevent air from entering the cavity through the aperture.

4. The plasma generator of claim 1, wherein a width of the aperture is at least 1 cm.

5. The plasma generator of claim 1, wherein a width of the aperture is less than a width of the high voltage electrode as measured in the same direction as the width of the aperture.

6. The plasma generator of claim 1, wherein a width of the aperture is greater than a width of the high voltage electrode as measured in the same direction as the width of the aperture.

7. The plasma generator of claim 1, wherein a width of the aperture is within 10% of a width of the high voltage electrode as measured in the same direction as the width of the aperture.

8. The plasma generator of claim 1, wherein a ratio of a width of the aperture to a height of the aperture is at least 3:1.

9. The plasma generator of claim 1, wherein the aperture has a rectangular shape.

10. A method of generating a plasma jet utilizing the plasma generator of claim 1 comprising steps of:

feeding a carrier gas into the cavity of the plasma generator of claim 1 to cause the carrier gas to flow from the at least one gas inlet through the aperture; and applying a pulsed voltage at a regulated frequency to the high voltage electrode while feeding the carrier gas.

11. The method of claim 10, wherein a gas introduced into the cavity through the at least one gas inlet comprises at least 90% by volume of a noble gas or at least 90% by volume of a mixture of noble gasses.

12. The method of claim 10, wherein a volume and velocity of a gas entering the at least one gas inlet is sufficient to prevent air from entering the cavity through the aperture.

13. The method of claim 10, wherein a distance between the high voltage electrode and the grounded electrode measured through air outside of the dielectric body is greater than a distance that would permit an electrical connection between the high voltage electrode and the grounded electrode when the plasma generator is in operation.

14. The method of claim 10, wherein a width of the aperture is at least 1 cm.

15. The method of claim 10, wherein a ratio of a width of the aperture to a height of the aperture is at least 3:1.

16. The method of claim 10, wherein the aperture has a rectangular shape.

17. A method of using plasma for cancer therapy comprising the step of treating a subject with cancer with the plasma generated by the method of claim 10.

18. The method according to claim 17, wherein the plasma jet is generated using an excitation voltage of from 5 to 40 kV, a pulse repetition frequency of from 50 to 3000 Hz, and a pulse width of from 20 ns to 20 μs.

19. The method according to claim 17, wherein the cancer is treated for 10-50 seconds using a pulse frequency of 15-75 Hz and a plasma treatment energy of 50-7000 mJ.

20. The method according to claim 17, comprising directly exposing cancerous tissue to the plasma jet using an excitation voltage of from 20 to 40 kV, a pulse repetition frequency of from 20 to 30 Hz, a gap distance of from 0.1 mm to 2 mm, and a pulse width of from 1 to 20 seconds.

* * * * *